US012544651B2

(12) United States Patent
Girlya et al.

(10) Patent No.: US 12,544,651 B2
(45) Date of Patent: Feb. 10, 2026

(54) AMUSEMENT ACTIVITY STATION

(71) Applicant: EPR Excavate, LLC, Kansas City, MO (US)

(72) Inventors: Ilya Girlya, West Berlin, NJ (US); Yan Girlya, West Berlin, NJ (US)

(73) Assignee: EPR Excavate, LLC, Kansas City, MO (US)

( * ) Notice: Subject to any disclaimer, the term of this patent is extended or adjusted under 35 U.S.C. 154(b) by 824 days.

(21) Appl. No.: 17/738,468

(22) Filed: May 6, 2022

(65) Prior Publication Data

US 2023/0356063 A1 Nov. 9, 2023

(51) Int. Cl.
*A63F 9/02* (2006.01)

(52) U.S. Cl.
CPC ..... *A63F 9/02* (2013.01)

(58) Field of Classification Search
CPC ..... A63F 9/02
See application file for complete search history.

(56) References Cited

U.S. PATENT DOCUMENTS

| | | | | |
|---|---|---|---|---|
| 509,601 A | | 11/1893 | Kelly | |
| 1,055,983 A | * | 3/1913 | Upton | A63F 9/02 273/333 |
| 1,257,069 A | | 2/1918 | Burke | |
| D181,093 S | | 10/1957 | Durant | |
| 2,950,917 A | * | 8/1960 | George | A63F 9/02 273/332 |
| D210,137 S | | 2/1968 | Payne | |
| D235,896 S | | 7/1975 | Rreneman | |
| 4,125,262 A | * | 11/1978 | Erickson | A63F 3/00075 273/289 |

(Continued)

FOREIGN PATENT DOCUMENTS

| | | | |
|---|---|---|---|
| CA | 2045417 | 12/1992 | |
| WO | WO-8705821 A1 * | 10/1987 | A63G 1/10 |

OTHER PUBLICATIONS

"Diggerland, USA, Excavators, Tractors", posted Dec. 30, 2014 [online], [retrieved Apr. 1, 2024]. Retrieved from internet, https://www.youtube.com/watch?v=tPPmyLAQDO8.

(Continued)

*Primary Examiner* — Raleigh W Chiu
(74) *Attorney, Agent, or Firm* — Stinson LLP

(57) ABSTRACT

An amusement activity station enables a user participant to operate complex machinery to direct a primary striker object into contact with at least one secondary target object to promote complex machinery-based, object-to-object contact skills. The amusement activity station includes a complex machine component and a secondary object contact station. The complex machine includes a user position station, a user-to-machine interface, and a moveable member. The moveable member is movable relative to the user position station by way of the user-to-machine interface as manually operated by the user participant. The secondary object contact station includes the secondary target object(s). The moveable member is directable toward the secondary target object(s) for contacting the same via the primary striker object as attached to the moveable member. A reset mechanism resets the secondary target objects from moved or fallen positions to original or upright positions.

17 Claims, 23 Drawing Sheets

(56) References Cited

U.S. PATENT DOCUMENTS

| | | | | | |
|---|---|---|---|---|---|
| 4,350,344 | A * | 9/1982 | Bear | A63F 9/02 273/357 |
| 4,702,480 | A * | 10/1987 | Popeski | A63F 9/02 4/597 |
| D309,922 | S | 8/1990 | Jorgensen | |
| D310,547 | S | 9/1990 | Wikner | |
| D343,219 | S | 1/1994 | Unterberger | |
| D345,993 | S | 4/1994 | Sweetland | |
| 5,681,043 | A * | 10/1997 | Winblad | A63B 65/12 124/64 |
| D391,272 | S | 2/1998 | Jin | |
| D406,152 | S | 2/1999 | Miyaoka | |
| D412,918 | S | 8/1999 | Nagai | |
| 6,042,114 | A * | 3/2000 | Phillip | A63F 9/02 273/142 D |
| D518,071 | S | 3/2006 | Gwak | |
| D523,880 | S | 6/2006 | Christensen | |
| D577,753 | S | 9/2008 | Lund | |
| D589,543 | S | 3/2009 | Lin | |
| D595,752 | S | 7/2009 | Lin | |
| D609,252 | S | 2/2010 | Shimada | |
| D633,926 | S | 3/2011 | Shimada | |
| D635,600 | S | 4/2011 | Wu | |
| 8,015,890 | B2 | 9/2011 | Christensen | |
| D665,433 | S | 8/2012 | Beam | |
| 8,281,677 | B2 | 10/2012 | Duck | |
| 8,495,924 | B2 | 7/2013 | Fukano | |
| D692,924 | S | 11/2013 | Hatanaka | |
| D695,798 | S | 12/2013 | Wu | |
| D707,261 | S | 6/2014 | Caboret | |
| D752,112 | S | 3/2016 | Hagura | |
| D776,729 | S | 1/2017 | Wu | |
| D830,422 | S | 10/2018 | Colclough | |
| D842,344 | S | 3/2019 | Okuyama | |
| D855,660 | S | 8/2019 | Jilbert | |
| 2007/0169578 | A1 | 7/2007 | Christensen | |
| 2023/0356063 | A1 * | 11/2023 | Girlya | A63F 9/02 |
| 2023/0356065 | A1 | 11/2023 | Girlya | |

OTHER PUBLICATIONS

"Diggerland Is A Construction-Themed Amusement Park With Heavy Machinery For Kids", posted Feb. 22, 2018 [online], [retrieved Jan. 4, 2020]. Retrieved from internet. https://www.youtube.com/watch?v=yiBx3fCKZs.

"Let's Play At Diggerand", posted May 9, 2019 [online], [retrieved Jan. 4, 2020]. Retrieved from Internet, https://www.youtube.com/watch?v=eFtPOHgGoUo.

* cited by examiner

AMUSEMENT ACTIVITY STATION

BACKGROUND OF THE INVENTION

Field of the Invention

The present invention generally relates to an amusement park activity. More particularly, the present invention relates to amusement activity or game er activity station by way of which user participants may operate complex machinery to target secondary objects with a primary striker object attached to a moveable arm or arm-like member of the complex machinery.

Brief Description of the Prior Art

Amusement parks and theme parks continuously face challenges attracting return visitors and new visitors. Past visitors may elect to not return, and potential new visitors may elect to not travel to a park that, in their opinion, does not regularly offer guest experience components that are new, innovative or different relative to those of other parks. To be successful, amusement or theme parks need to regularly introduce new, innovative and fun guest experiences. A primary objective according to the present invention is to provide an amusement activity or game station that is new, innovative, fun and different relative to prior art attractions.

An additional objective of the present invention is to provide an amusement attraction that is sufficiently mobile to be transported (including by any truck, tractor or other vehicle, machine, vessel or container, or any combination thereof) such as for use in or by a temporary or traveling carnival or amusement event or location, or at any other temporary location such as a parking area or common area of a commercial (e.g., office, warehouse or mixed-use), retail (e.g., mall or other shopping center) or institutional (e.g., governments, school hospital, heath care, etc.) property, such as for a temporary amusement attraction as part of a gathering, party, fundraiser or other event.

A first exemplary amusement attraction is referenced in U.S. Pat. No. 10,166,485 ('485 patent) authored by Girlya et al. and owned by Diggerland USA, LLC in West Berlin, New Jersey. The '485 patent describes an amusement ride, attraction or device comprising a modified vehicle, machine, vessel, container, load-carrying platform or similar device, or any combination thereof, or anything having the appearance thereof, which is used, useful or operated for mining, transportation, military or construction or other commercial or industrial uses, purposes or applications. Illustrative embodiments of the invention include a modified dump trailer, dump truck or load-carrying platform. Such a modified dump trailer includes a dump trailer modified so as to permit a horizontally-pivoting telescoping hydraulic cylinder to raise and lower the front of the modified dump trailer, which is modified with a passenger support system and a passenger restraint system. Associated processes, systems and methods include a power pack or other dedicated source of energy and an adjacent entrance/exit ramp and boarding/de-boarding platform and operator control platform.

A second exemplary amusement attraction is referenced in U.S. Pat. No. 10,946,296 ('296 patent) also authored by Girlya et al. The '296 patent describes an amusement ride that provides user participants with the sensation of riding scissor lift construction equipment. The amusement ride has a scissor lift mechanism supported by a construction equipment frame with wheels thereon. A stationary support structure supports the equipment frame and suspends the wheels in midair to hold the equipment stationary. A cargo lift platform connected on top of the scissor lift mechanism has amusement ride seats mounted thereon. The ride seats have passenger restraints which provides amusement-ride-level safety. An electric motor drivingly connected to the scissor lift mechanism is operated by a ride operator to raise and lower the cargo lift platform. A passenger access platform situated adjacent the cargo lift platform allows ride passengers to easily and safely enter and exit the scissor lift.

From a consideration of the foregoing, it will be noted that the prior art perceives a need for an amusement attraction that, instead of being passively ridden by a park guest, offers an opportunity that enables user participants to individually operate complex machinery in a safe, amusing manner. More particularly, the prior art perceives a need for an amusement activity or game station for enabling a user to operate complex machinery to direct a first or primary striker object into contact with at least one secondary object and thereby improve or maintain operable complex machinery object-to-object contact skills as summarized in more detail hereinafter.

SUMMARY OF THE INVENTION

As prefaced above, a primary objective of this invention is the provision of an amusement activity or game station for generally offering user participants an opportunity to individually operate machinery in a safe, amusing or entertaining manner. The presently disclosed subject matter enables a user to operate complex machinery to direct a first or primary striker object into contact with at least one secondary object and thereby improve or maintain operable complex machinery object-to-object contact skills. The amusement activity or game station according to the presently disclosed subject matter generally amuses or entertains user participants while improving, maintaining, or promoting complex machinery object-to-object contact skills, and may be said to essentially comprise a complex machine and a secondary object contact station.

The complex machine according to the present invention preferably comprises a user position station, a user-to-machine interface, and a moveable member. The moveable member is movable relative to the user position station by way of the user-to-machine interface as manually operated by the user. The secondary object contact station is positioned opposite the complex machine and preferably comprises at least one, but preferably a series of secondary objects. The moveable member is directable toward the secondary object(s) in at least a first direction for contacting the secondary object(s) by way of the primary striker object as attached to the moveable member.

The amusement activity or game station according to the present invention may further preferably comprise a number of features, including a reset mechanism for resetting the secondary object(s). In this regard, it is contemplated that in the preferred embodiment the secondary objects may pivot from a substantially vertical or upright position to a substantially horizontal or fallen position when the first or primary striker object is directed into and contact is made with the secondary object(s). Alternative movements of the secondary target objects are further contemplated, including but not necessarily limited to hanging secondary target objects or secondary target objects that are aligned sideways relative to the user participant.

When contact is made with the secondary target objects, the objects may be flipped up, knocked loose, or rotated about an axis perpendicular to the ground surface. The reset mechanism(s) as illustrated in these specifications are primarily operable to reset the secondary objects to their original positions or from the substantially horizontal or fallen position to the substantially vertical or upright position, but may also operate to reset the secondary target object to their original positions from their otherwise contact-displaced positions.

The first or primary striker object is preferably attached to the moveable member via a tether element, which tether element is pivotally attached to the moveable member and fixedly attached to the first or primary striker object. The opposing pivotal and fixed attachment points enable the first or primary striker object to move under pendular motion relative to the moveable member. When the secondary object contact station is outfitted with a series of secondary objects, the secondary objects are preferably spaced from one another in at least one of first and second dimensions within certain secondary object spacing. The secondary object spacing enables the user participant to manipulate the moveable member in either of the first and second dimensions so as to develop or maintain skills required to accurately move the moveable member to and fro and/or from side to side.

The secondary object spacing is preferably, but not necessarily uniform between successive secondary objects positions. In a preferred embodiment, the successive secondary object positions are arranged from proximal to distal positions in the first dimension. Each secondary object may preferably further comprise a uniform secondary object height. The secondary object spacing is preferably greater than the secondary object height for allowing the series of secondary objects to be directed into the substantially horizontal or fallen position within the secondary object spacing. While uniform spacing between successive series of secondary target objects may be preferred, alternative non-uniform spacing between, as well as non-uniform shapes and dimensions of secondary target objects are contemplated as falling within the ambit of these specifications although not specifically illustrated.

Distally positioned or distal-positioned secondary objects are preferably laterally staggered relative to proximally positioned or proximal-positioned secondary objects and the lateral spacing between and shape of secondary objects may preferably be uniform. The series of secondary objects may preferably comprise an upper portion, a lower portion, and a neck portion. The upper portion may preferably comprise a maximum upper portion width and a maximum upper portion length or height. Similarly, the lower portion may preferably comprise a maximum lower portion width and a maximum lower portion length or height. The maximum lower portion width is preferably greater than the maximum upper portion width, and the maximum lower portion height is preferably greater than the maximum upper portion height.

The upper portion and lower portion dimensions thereby provide alternative target structure for directed movement of the first or primary striker object into each secondary object. In an exemplary embodiment, the series of secondary objects may preferably resemble bowling pins in at least the first dimension for providing a bowling pin arrangement resemblance. The bowling pin arrangement resemblance creates a particularly amusing effect of the amusement activity or game station. Other similar types of themed arrangements may also be substituted in for the bowling pin arrangement resemblance as exemplified hereinabove by a cityscape resemblance opposite a wrecking ball type primary striker object.

The series of secondary objects are preferably arranged in a series of rows, which series of rows are preferably spaced according to the secondary object spacing. Each row may preferably comprise or essentially be defined by a pivot member. The secondary objects may preferably pivot about the pivot members when being directed from the substantially vertical or upright position to the substantially horizontal or fallen position. Each secondary object is preferably associated with a lift member, which lift members are fixedly attached to the pivot members such that the lift members may pivot in unison with the pivot members for lifting the secondary objects from the substantially horizontal or fallen position to the substantially vertical or upright position. Each lift member preferably comprises a lift member length or height. The lift member length or height is preferably lesser than the secondary object height such that the series of secondary objects thereby concealing from view the lift members during object reset movements.

The reset mechanism according to the present invention is cooperable with the pivot members and lift members. The reset mechanism preferably comprises or is characterized by a linear actuator mechanism and a reset member or bar. The linear actuator is coupled to the reset member and is operable to linearly actuate the reset member in at least to and fro movements. The linear actuator may be pivotally coupled to the reset member at a first actuator end, and the reset member may be coupled to the pivot members via linkage members. The linkage members are each dimensioned for cooperating with a maximum linear actuation state and a minimum linear actuation state of the linear actuator for pivoting the lift members through a preferred reset angle of rotation on the order of 90 rotational degrees. The linear actuator further comprises a secondary actuator end pivotally coupled to an anchor structure. The first and secondary actuator ends are pivotally coupled to opposed structure for enabling the linear actuator to pivot during reset movements of the resent mechanism and reduce structural strain on the mechanism.

The secondary object contact station may further preferably comprise laterally opposed members. The laterally opposed members are preferably affixed to a station platform and pivotally attached to each pivot member. The station platform and laterally opposed members function to fix the pivot axes extending through each pivot member. The station platform may further preferably comprise a contact station portion and a machinery support portion. The contact station portion supports the secondary object contact station and the machinery support portion supports the complex machinery.

The station platform may further preferably comprise a fixedly attached portion divider. The fixedly attached portion divider extends upwardly intermediate the contact station portion and the machinery support portion for preventing the complex machinery from being inadvertently directed into the secondary object contact station. The complex machine is preferably coupled or anchored to the fixedly attached portion divider thereby fixing the complex machine in position relative to the station platform. The station platform is further preferably fixedly attached or anchored to an underlying anchor support surface for fixing or anchoring the entire amusement activity or game station to the underlying anchor support surface.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of the invention will become more evident from a consideration of the following brief descriptions of patent drawings.

Figure 9:
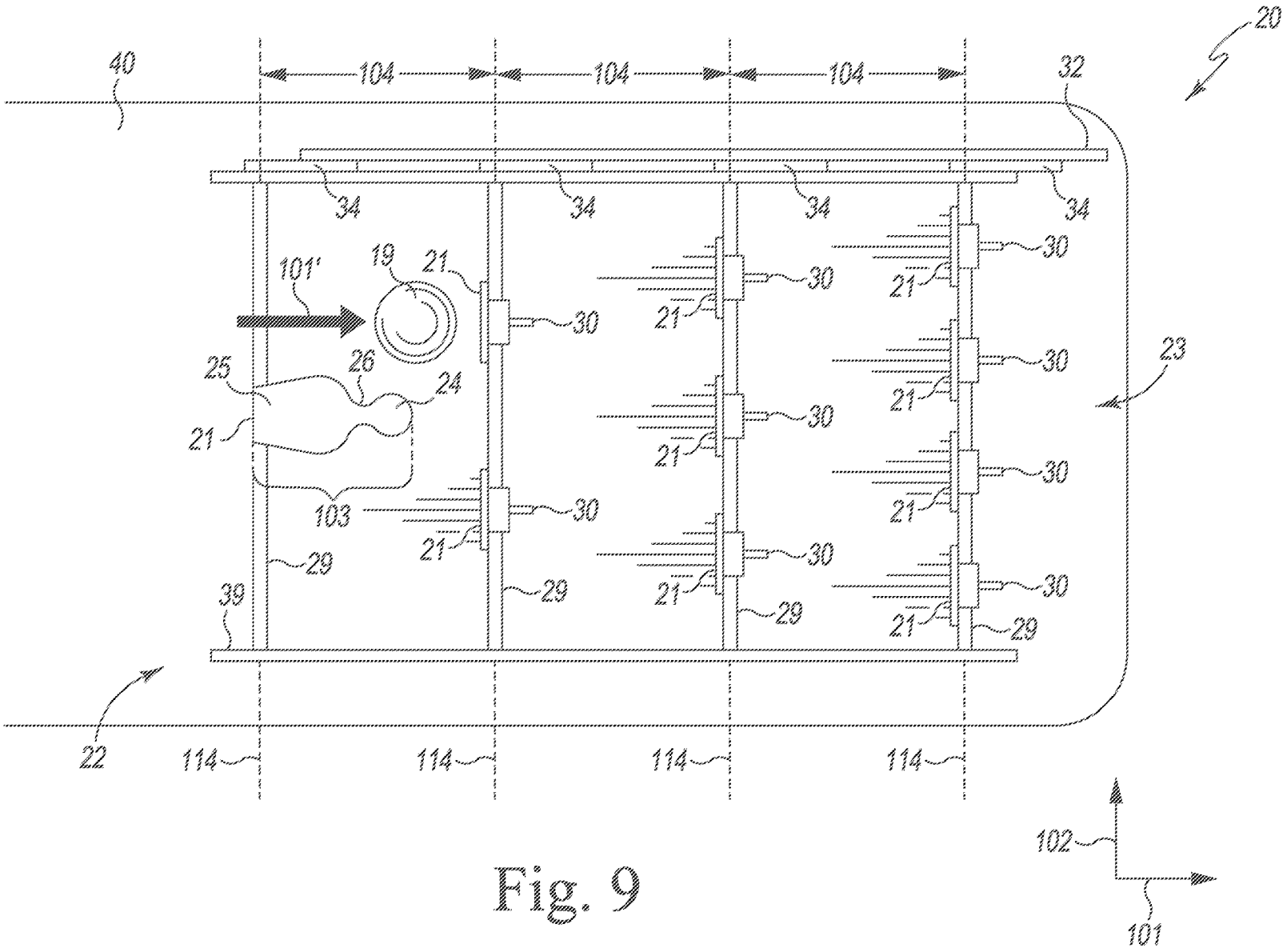

FIG. 9 is a second sequential, enlarged top plan view of the secondary object contact station supported by the station platform with the first or primary striker object being directed toward a second secondary object row past a first secondary object row at the proximal end of the secondary object contact station with a first secondary object at the first secondary object row being pivoted to a substantially horizontal fallen position.

Figure 10:
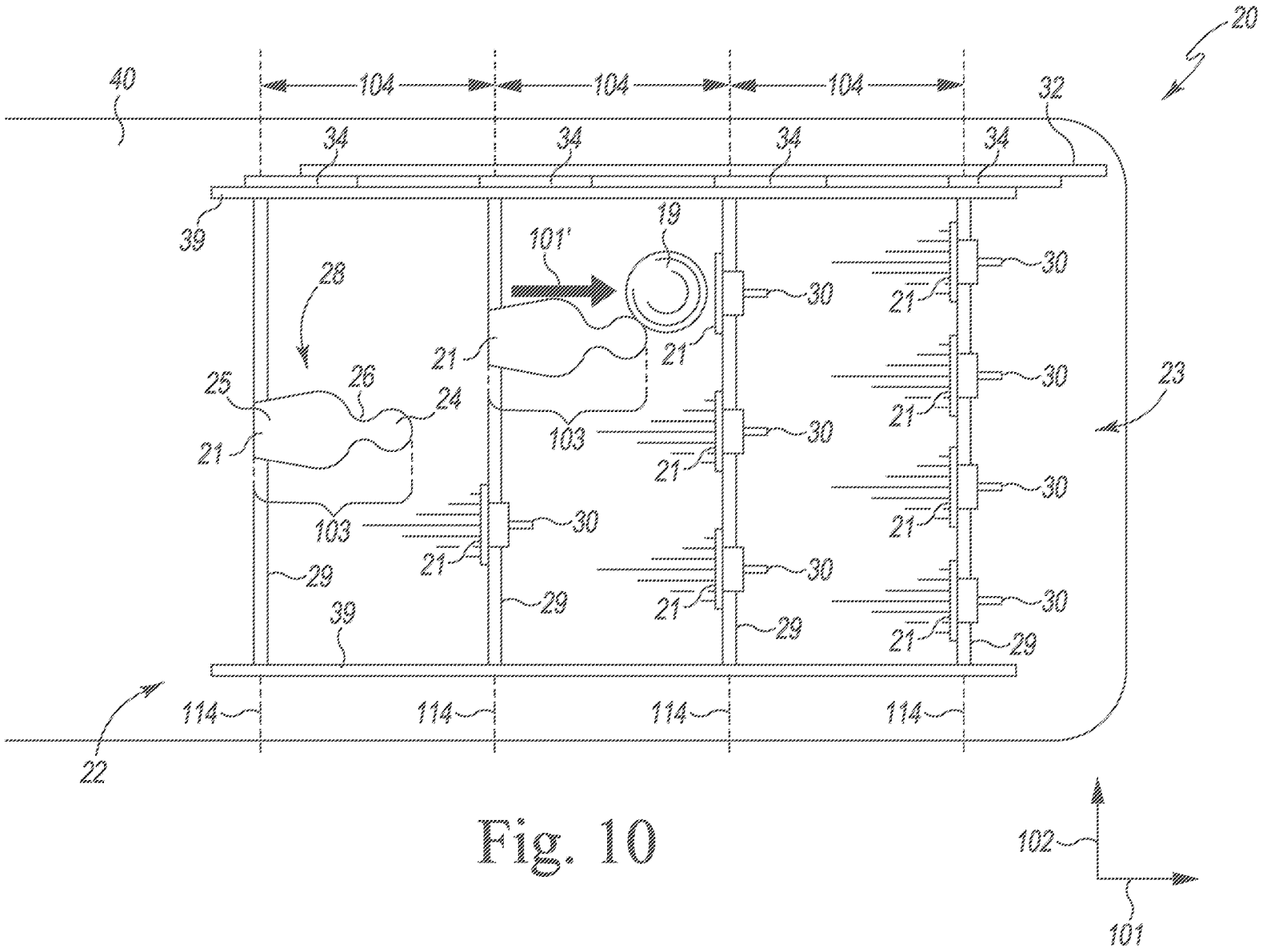

FIG. 10 is a third sequential, enlarged top plan view of the secondary object contact station supported by the station platform with the first or primary striker object being directed toward a third secondary object row past the second secondary object row at an intermediate portion of the secondary object contact station with the first secondary object at the first secondary object row being pivoted to a substantially horizontal fallen position and a second secondary object at the second secondary object row being pivoted to a substantially horizontal fallen position.

Figure 11:
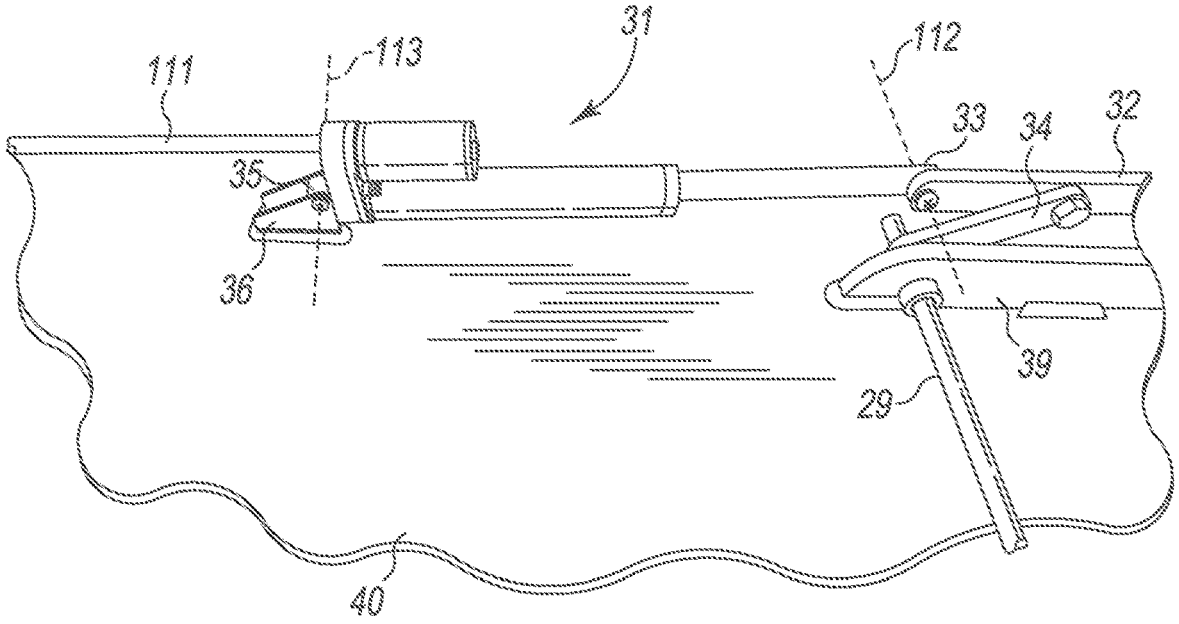

FIG. 11 is an enlarged perspective view of an exemplary linear actuator element connected to a reset bar or member as supported by a fragmentary station platform.

Figure 12:
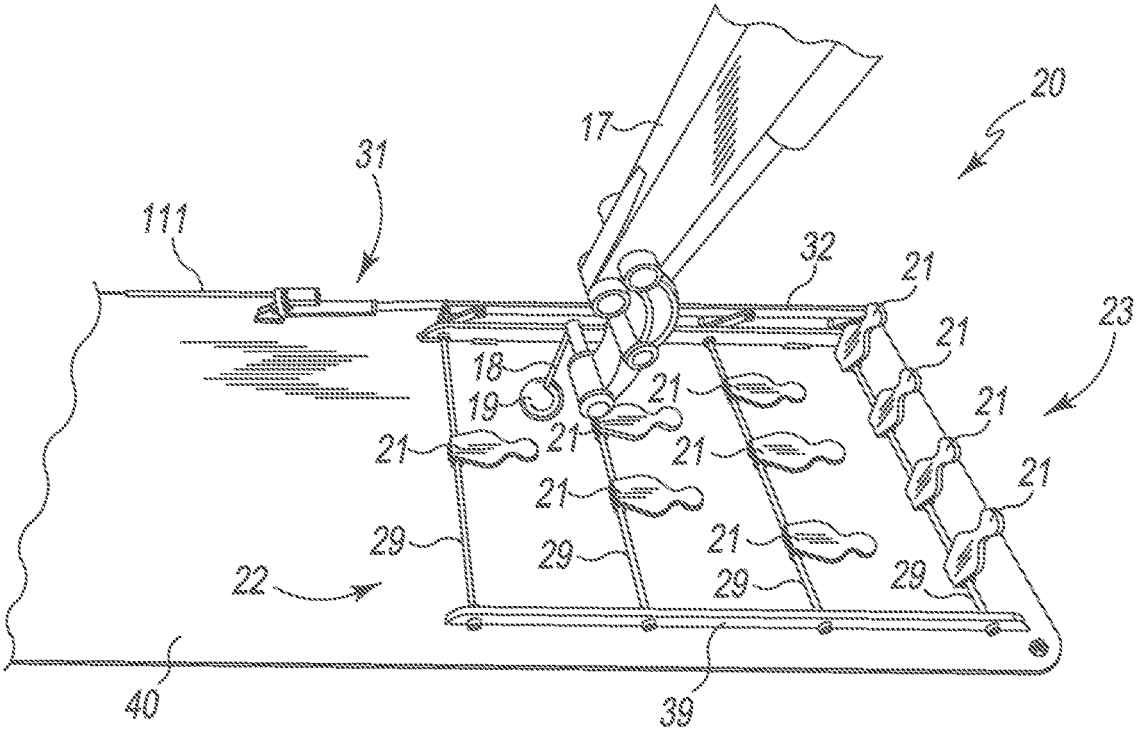

FIG. 12 is a first lateral perspective view of the moveable member positioned in superior adjacency to the secondary object contact station with a first series of secondary objects depicted in a substantially horizontal fallen position and a second series of secondary objects depicted in a substantially vertical upright position.

Figure 13:
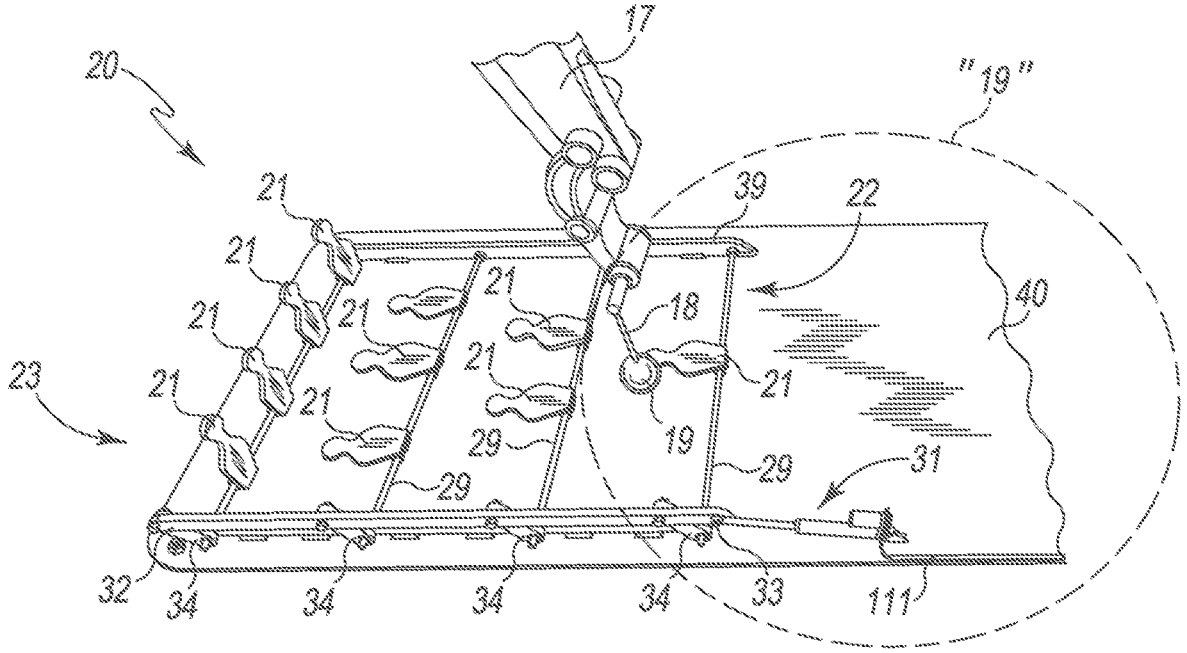

FIG. 13 is a second lateral perspective view (opposite the first lateral perspective view) of the moveable member positioned in superior adjacency to the secondary object contact station with the first series of secondary objects depicted in the substantially horizontal fallen position and the second series of secondary objects depicted in the substantially vertical upright position.

Figure 14:
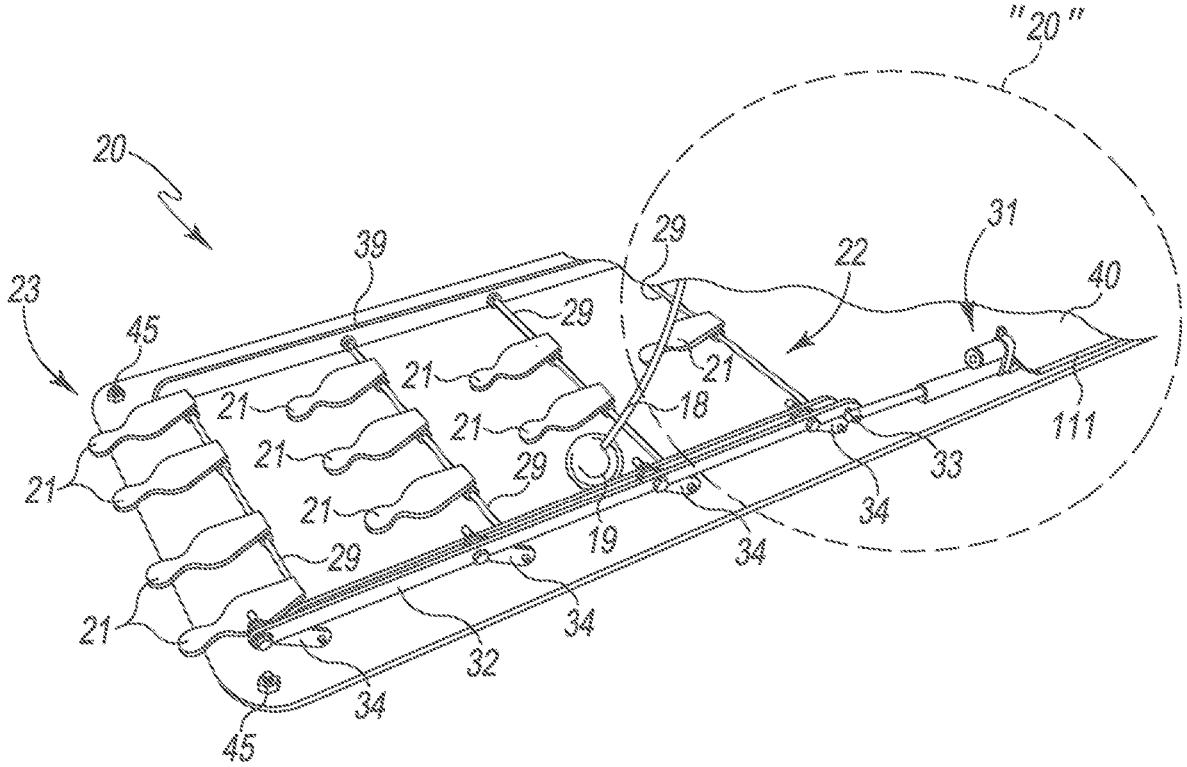

FIG. 14 is a first sequential distal end perspective view of the secondary object contact station with all secondary objects depicted in the substantially horizontal fallen position with the first or primary striker object being shown resting atop the station platform and the linear actuator element in a maximized linear actuation state prior to resetting the series of secondary objects into the substantially vertical upright position.

Figure 15:
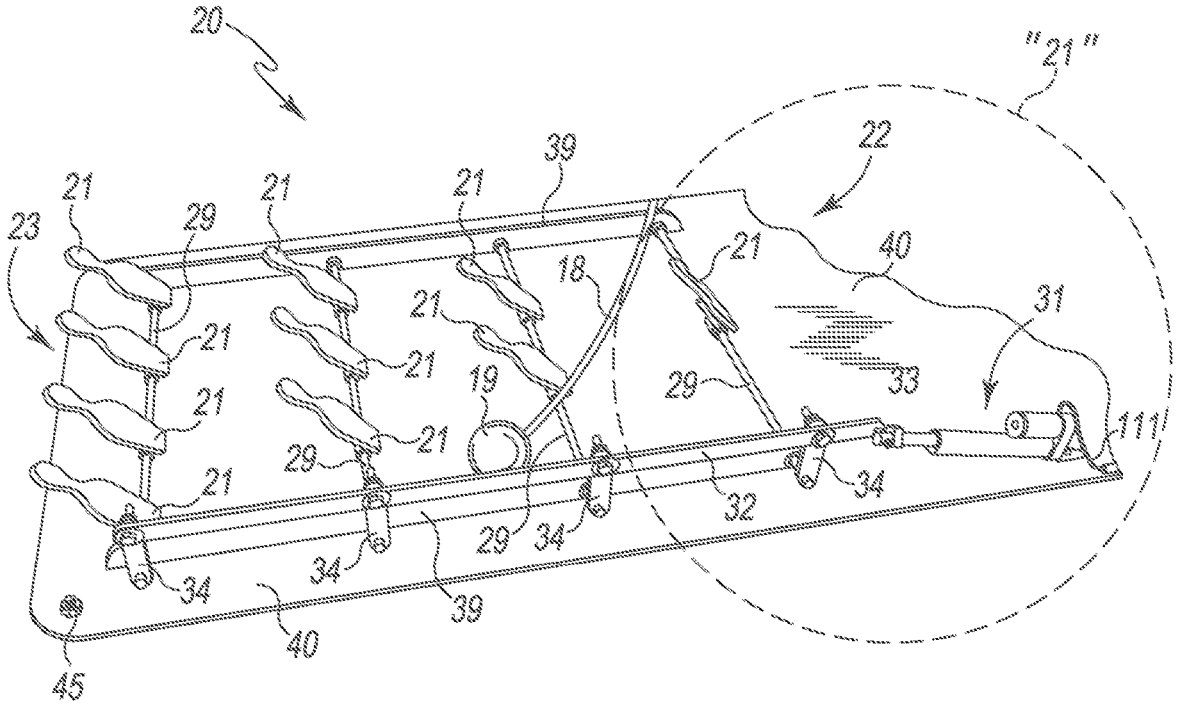

FIG. 15 is a second sequential lateral side perspective view of the secondary object contact station with all secondary objects depicted in an oblique position relative to the station platform and the linear actuator element in an intermediate linear actuation state during a reset movement of the series of secondary objects into the substantially vertical upright position.

Figure 16:
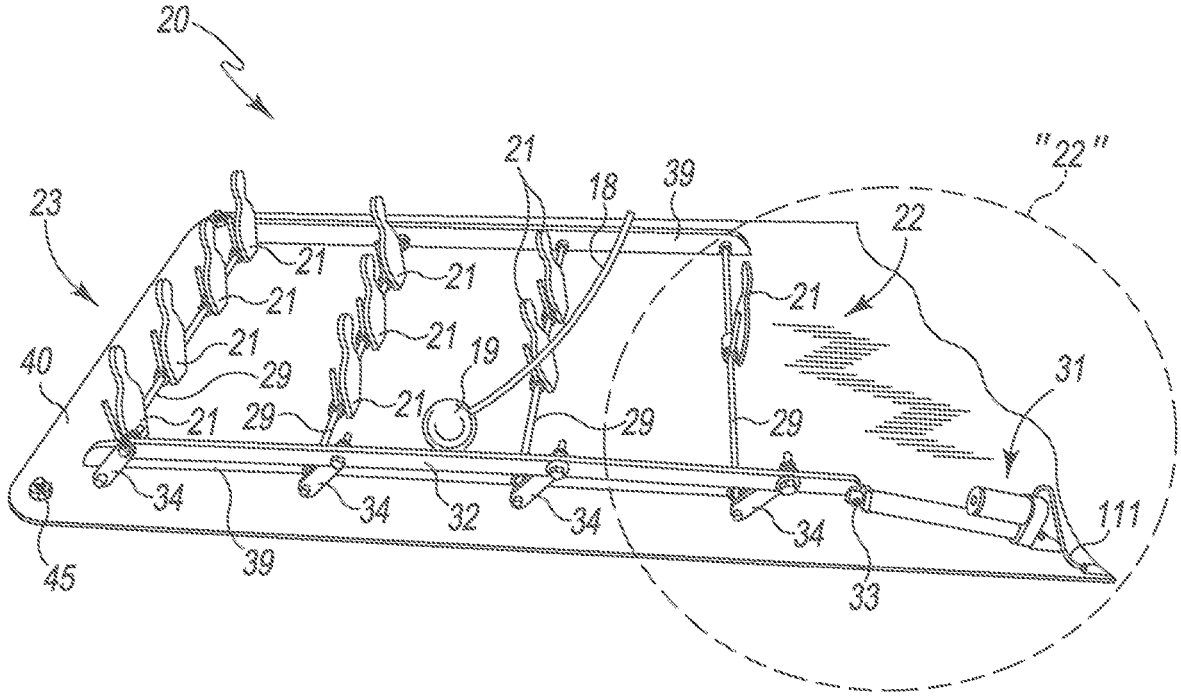

FIG. 16 is a third sequential lateral side perspective view of the secondary object contact station with all secondary objects depicted in the substantially vertical upright position relative to the station platform and the linear actuator element in a minimized linear actuation state during the reset movement of the series of secondary objects into the substantially vertical upright position.

Figure 17:
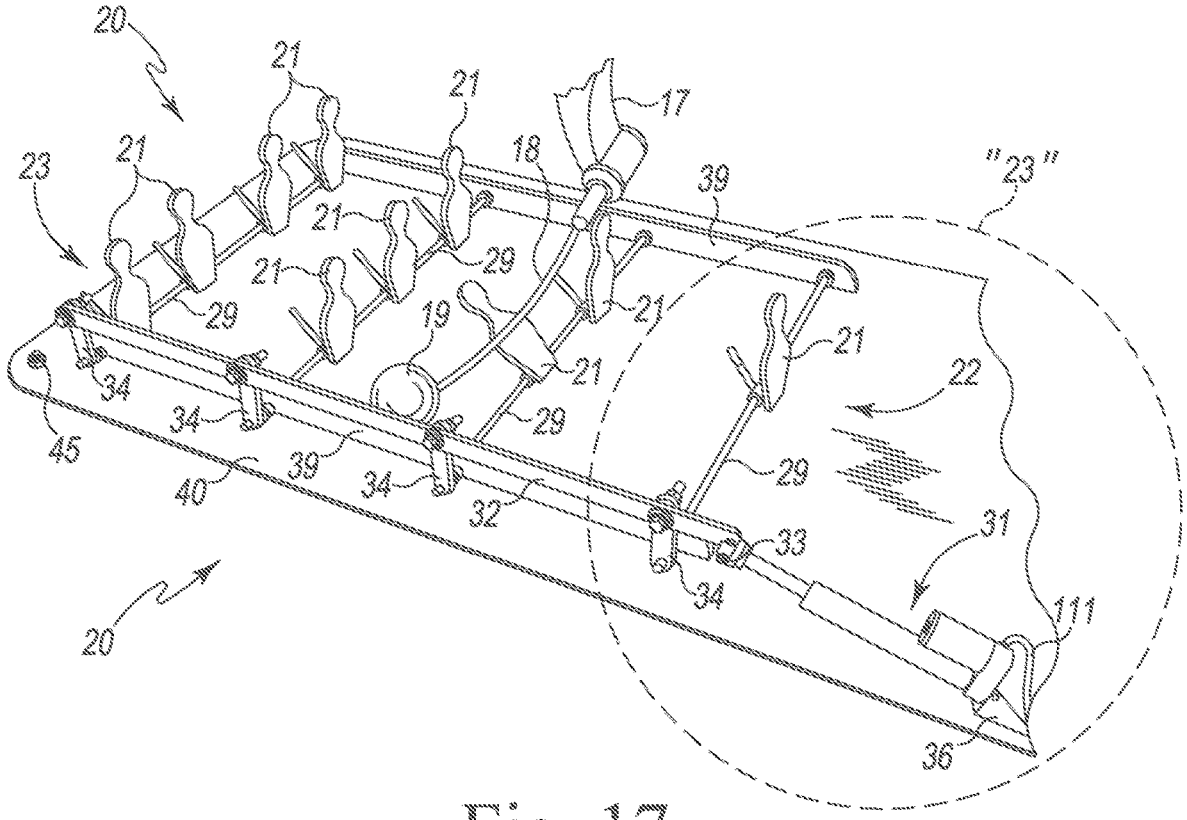

FIG. 17 is a fourth sequential proximal end perspective view of the secondary object contact station with a series of secondary objects depicted in the substantially vertical upright position relative to the station platform with a series of lift members being shown in an oblique angle relative to the station platform with a single secondary object in an oblique angle relative to the station platform as supported by a hidden obliquely angled lift member and the linear actuator element in an intermediate linear actuation state after the reset movement of the series of secondary objects into the substantially vertical upright position.

Figure 18:
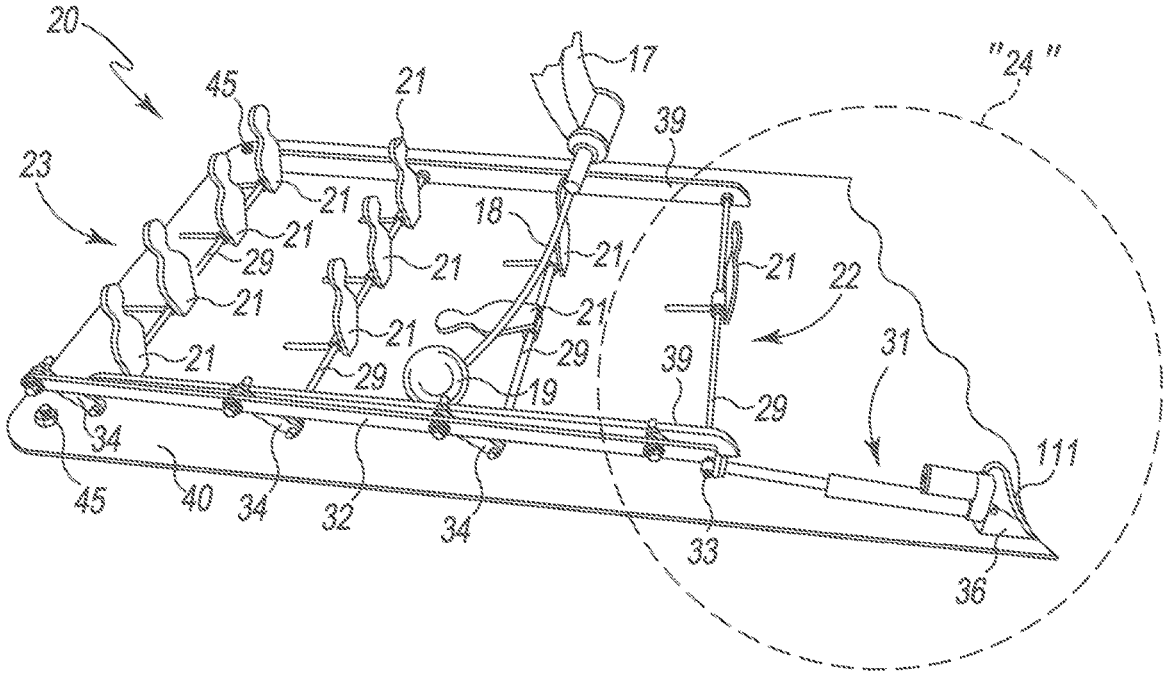

FIG. 18 is a fifth sequential lateral side perspective view of the secondary object contact station with a series of secondary objects depicted in the substantially vertical upright position relative to the station platform with the corresponding series of lift members being shown in a substantially horizontal fallen position with a single secondary object in the substantially horizontal fallen position as supported by a hidden substantially horizontal fallen lift member and the linear actuator element in a maximized linear actuation state after the reset movement of the series of secondary objects into the substantially vertical upright position.

Figure 19:
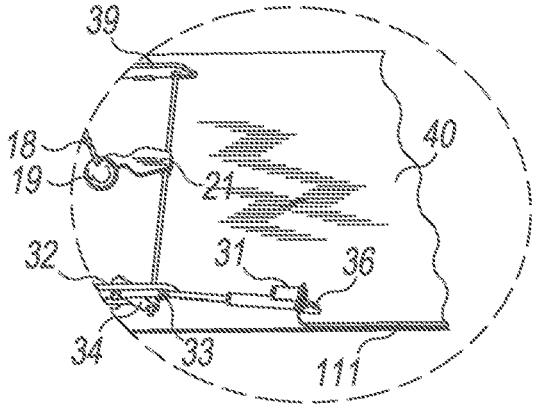

FIG. 19 is a reduced sectional view as reduced and sectioned from FIG. 13 to comparatively draw focus to the linear actuation state of the linear actuator element as depicted in FIG. 13.

Figure 20:
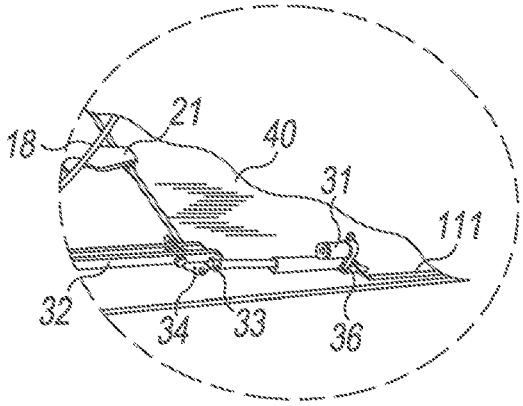

FIG. 20 is a reduced sectional view as reduced and sectioned from FIG. 14 to comparatively draw focus to the linear actuation state of the linear actuator element as depicted in FIG. 14.

Figure 21:
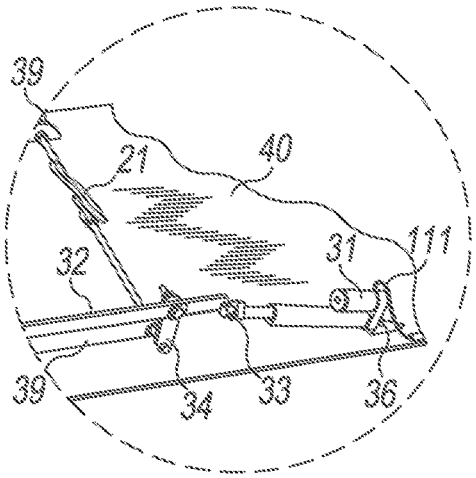

FIG. 21 is a reduced sectional view as reduced and sectioned from FIG. 15 to comparatively draw focus to the linear actuation state of the linear actuator element as depicted in FIG. 15.

Figure 22:
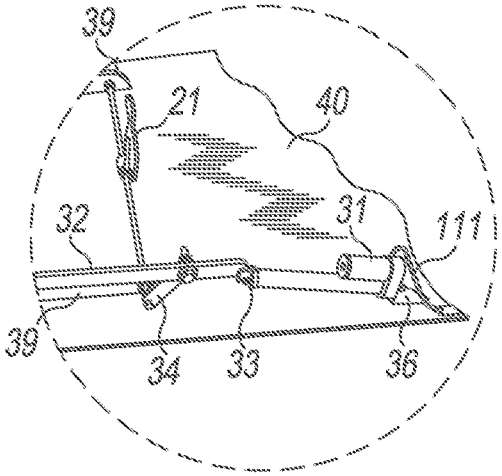

FIG. 22 is a reduced sectional view as reduced and sectioned from FIG. 16 to comparatively draw focus to the linear actuation state of the linear actuator element as depicted in FIG. 16.

Figure 23:
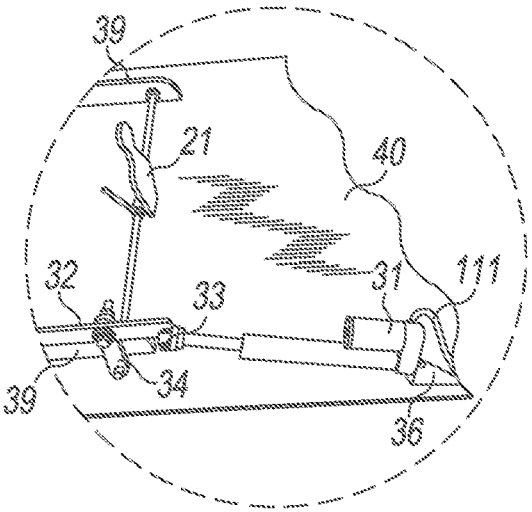

FIG. 23 is a reduced sectional view as reduced and sectioned from FIG. 17 to comparatively draw focus to the linear actuation state of the linear actuator element as depicted in FIG. 17.

Figure 24:
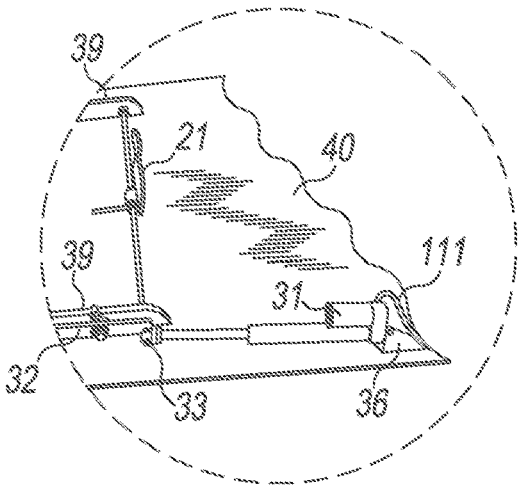

FIG. 24 is a reduced sectional view as reduced and sectioned from FIG. 18 to comparatively draw focus to the linear actuation state of the linear actuator element as depicted in FIG. 18.

Figure 25:
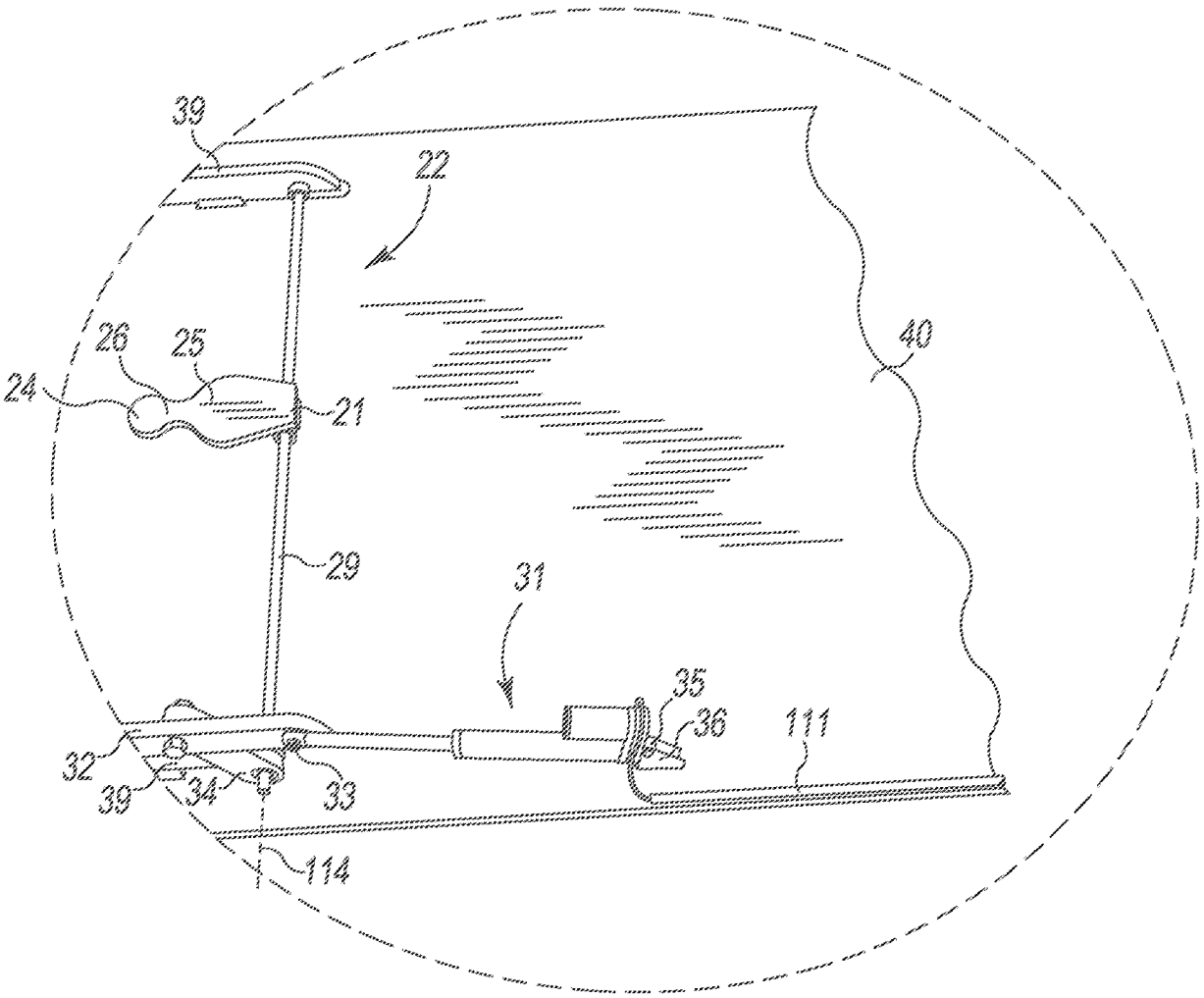

FIG. 25 is an enlarged sectional view as enlarged and sectioned from FIG. 13 to show in greater clarity the linear actuation state of the linear actuator element as depicted in FIG. 13.

Figure 26:
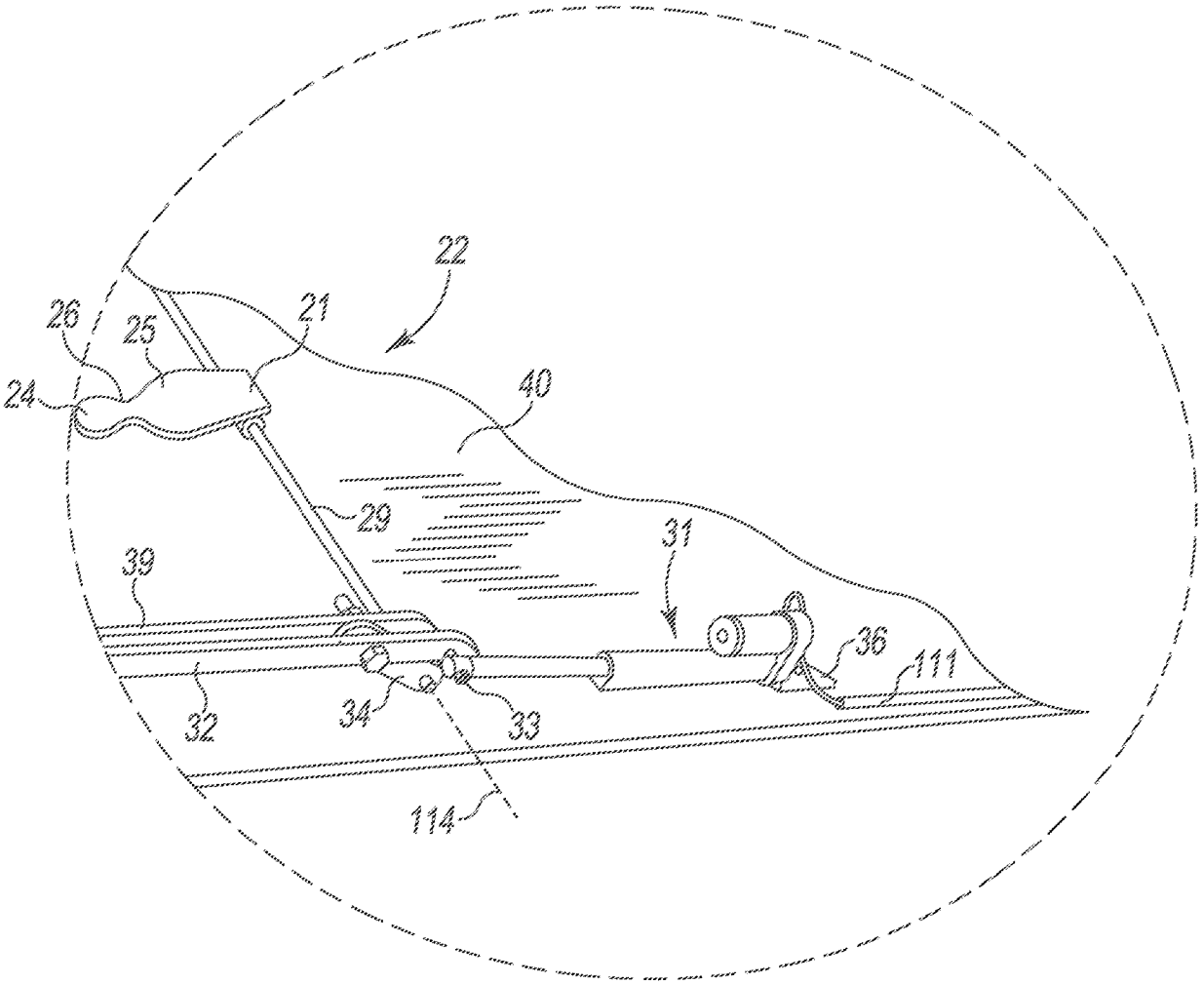

FIG. 26 is an enlarged sectional view as enlarged and sectioned from FIG. 14 to show in greater clarity the linear actuation state of the linear actuator element as depicted in FIG. 14.

Figure 27A:
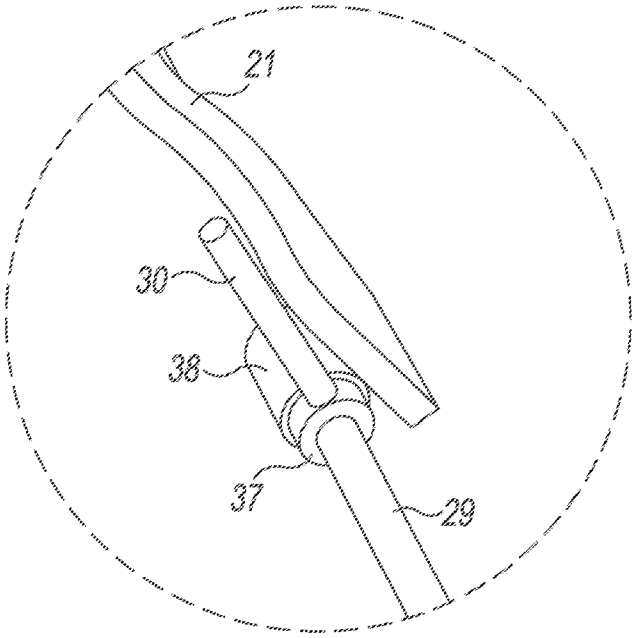
Figure 27:
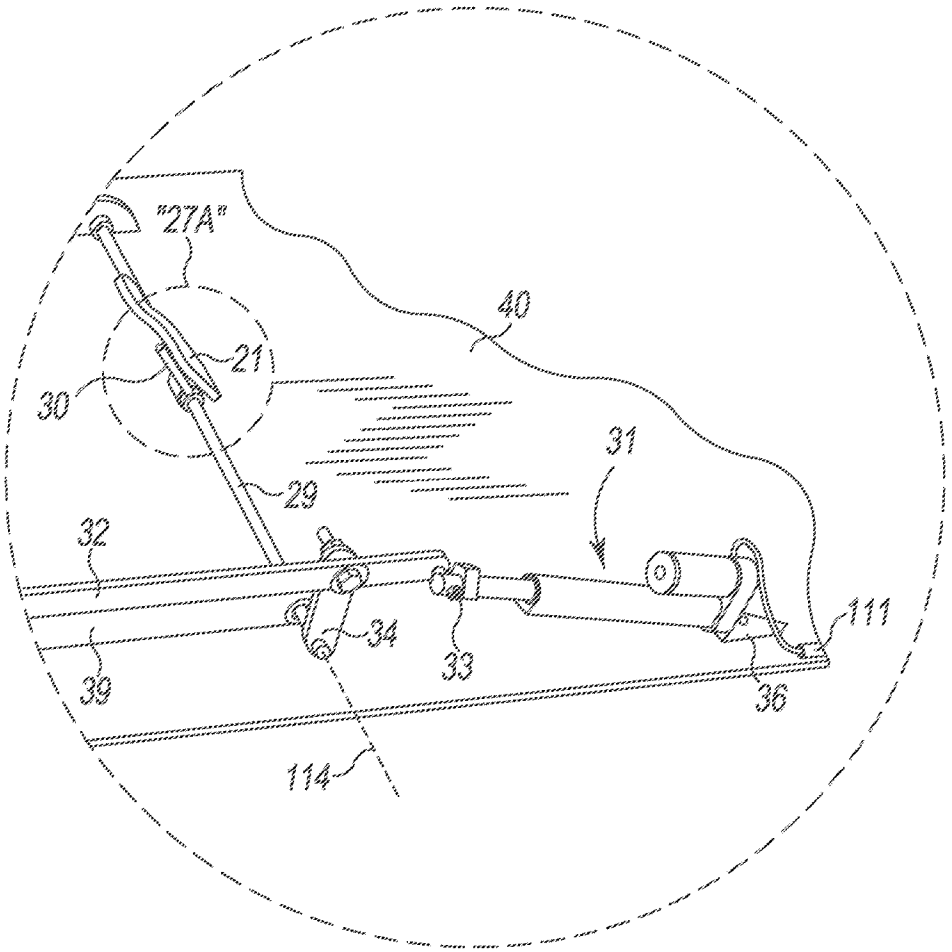

FIG. 27 is an enlarged sectional view as enlarged and sectioned from FIG. 15 to show in greater clarity the linear actuation state of the linear actuator element as depicted in FIG. 15.

FIG. 27A is an enlarged sectional view as enlarged and section from FIG. 27 to show in greater clarity the lift member and knuckle elements associated with the illustrated secondary object.

Figure 28A:
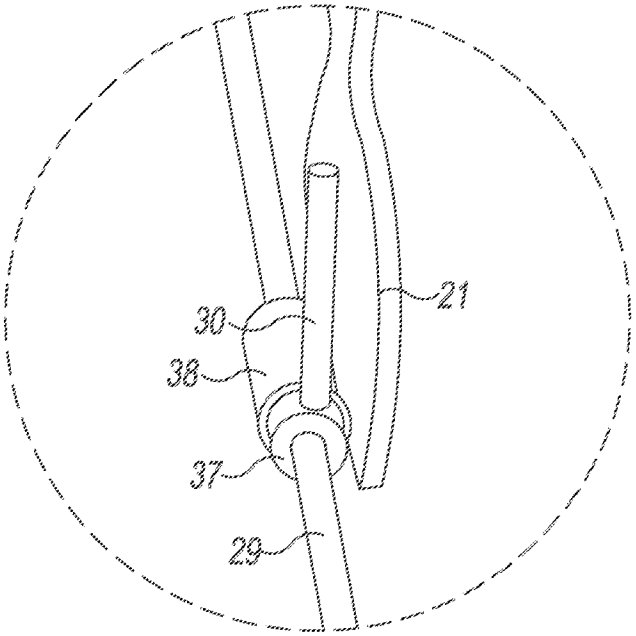
Figure 28:
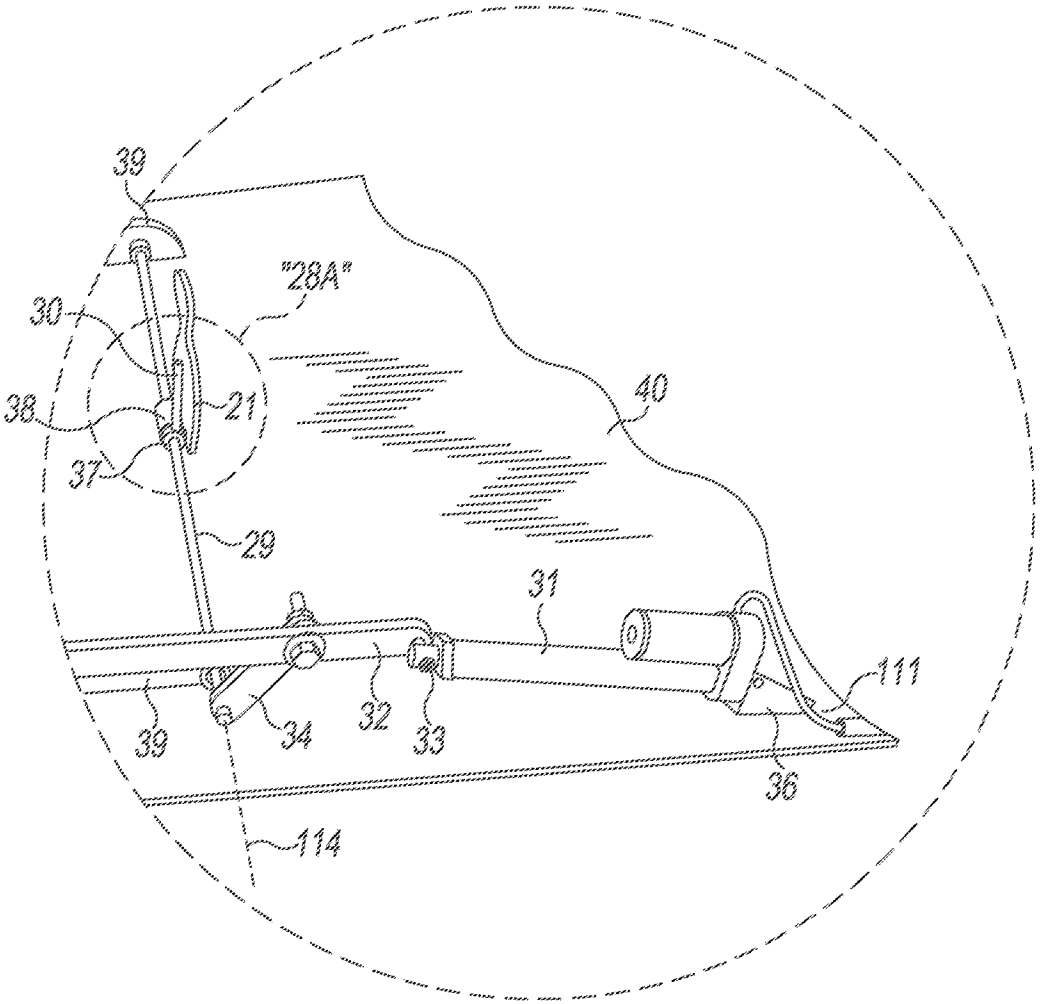

FIG. 28 is an enlarged sectional view as enlarged and sectioned from FIG. 16 to show in greater clarity the linear actuation state of the linear actuator element as depicted in FIG. 16.

FIG. 28A is an enlarged sectional view as enlarged and section from FIG. 28 to show in greater clarity the lift member and knuckle elements associated with the illustrated secondary object.

Figure 29A:
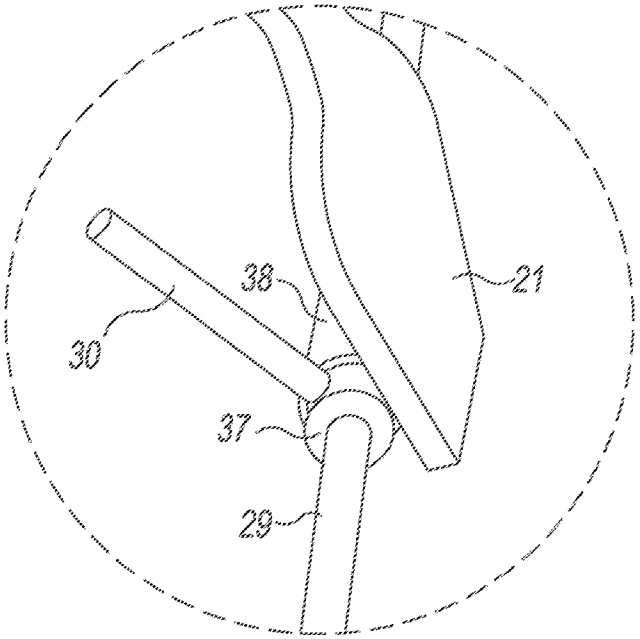
Figure 29:
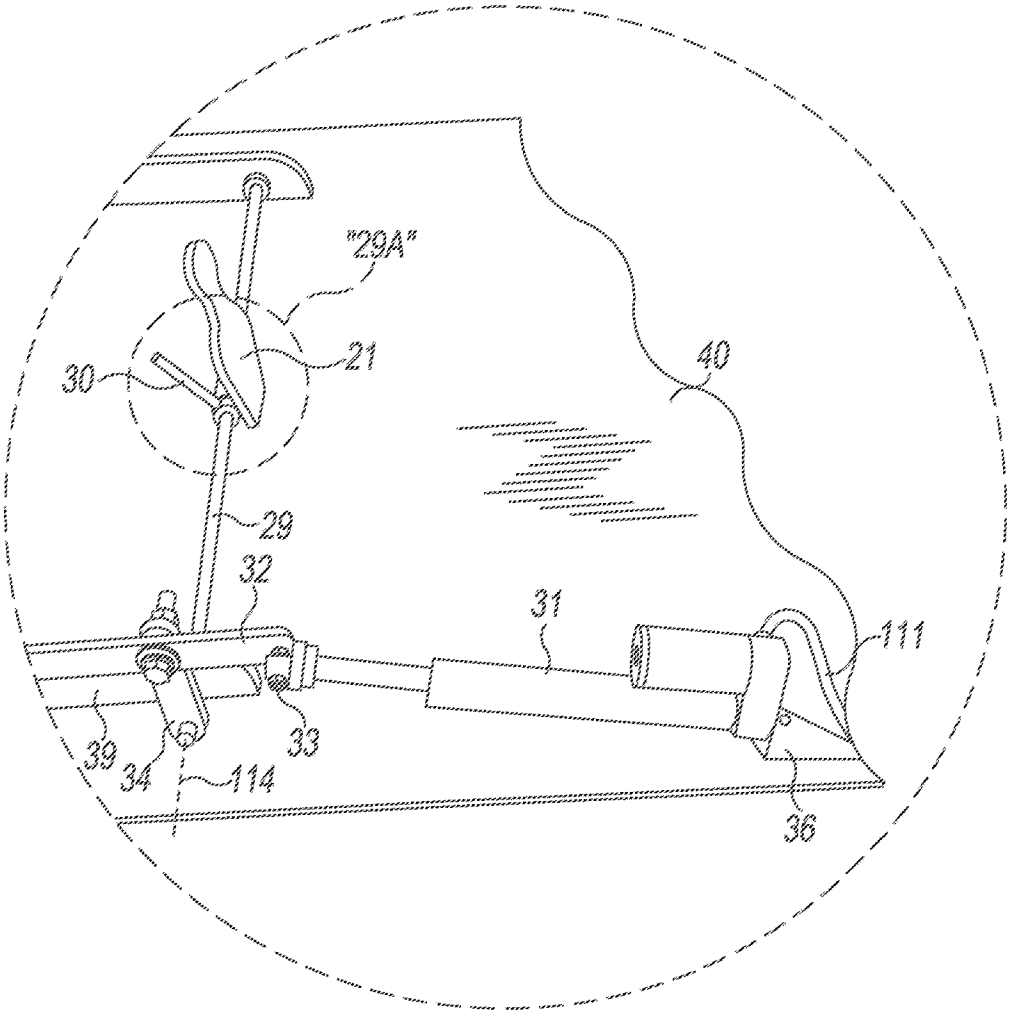

FIG. 29 is an enlarged sectional view as enlarged and sectioned from FIG. 17 to show in greater clarity the linear actuation state of the linear actuator element as depicted in FIG. 17.

FIG. 29A is an enlarged sectional view as enlarged and section from FIG. 29 to show in greater clarity the lift member and knuckle elements associated with the illustrated secondary object.

Figure 30A:
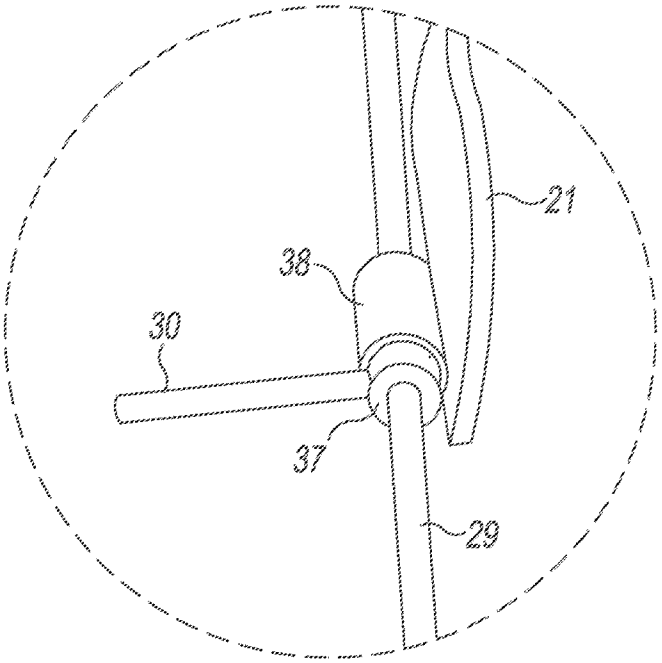
Figure 30:
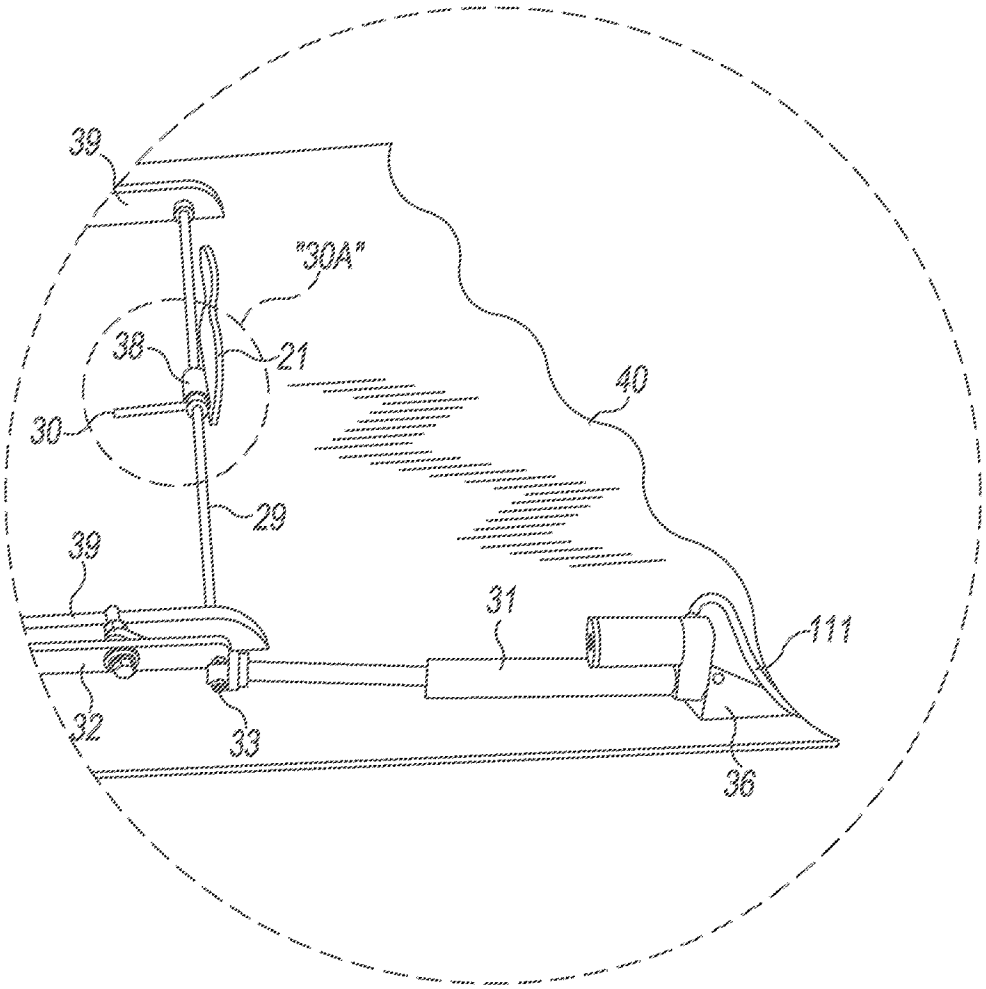

FIG. 30 is an enlarged sectional view as enlarged and sectioned from FIG. 18 to show in greater clarity the linear actuation state of the linear actuator element as depicted in FIG. 18.

FIG. 30A is an enlarged sectional view as enlarged and section from FIG. 30 to show in greater clarity the lift member and knuckle elements associated with the illustrated secondary object.

Figure 34:
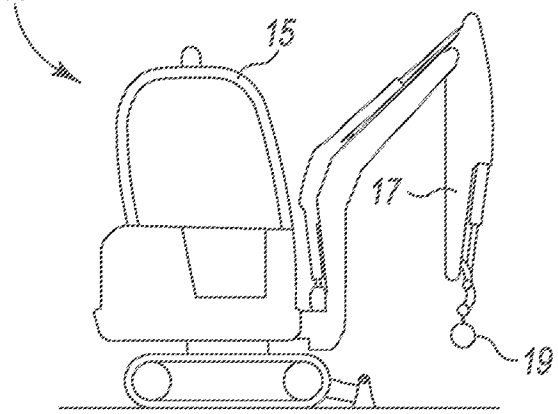
Figure 31:
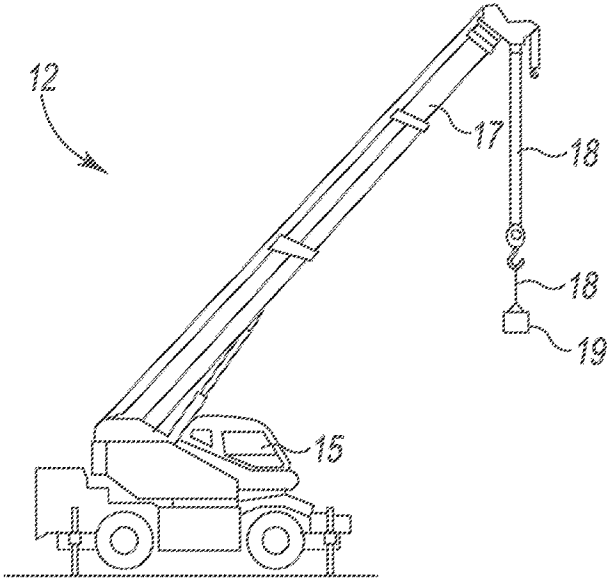

FIG. 31 is a reduced side elevational view of a first alternative complex machine as an alternative to the preferred complex machine otherwise depicted in FIG. 34.

Figure 32:
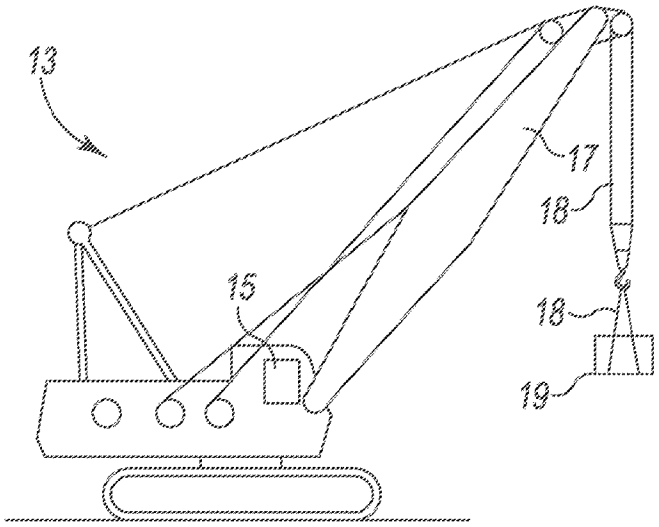

FIG. 32 is a reduced side elevational view of a second alternative complex machine as an alternative to the preferred complex machine otherwise depicted in FIG. 34.

Figure 33:
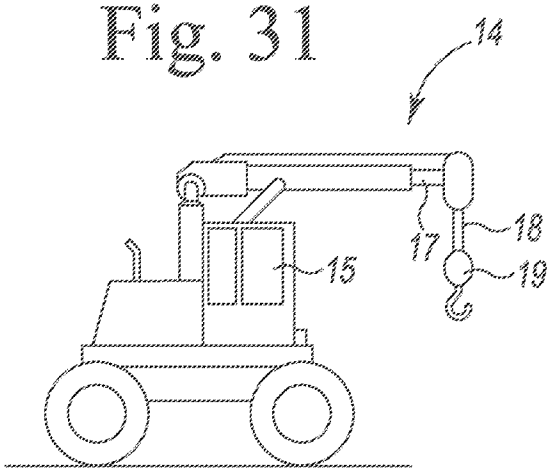

FIG. 33 is a reduced side elevational view of a third alternative complex machine as an alternative to the preferred complex machine otherwise depicted in FIG. 34.

FIG. 34 is a reduced side elevational view of the preferred complex machine shown juxtaposed on the same sheet with FIGS. 32-34 for comparative purposes.

Figure 35:
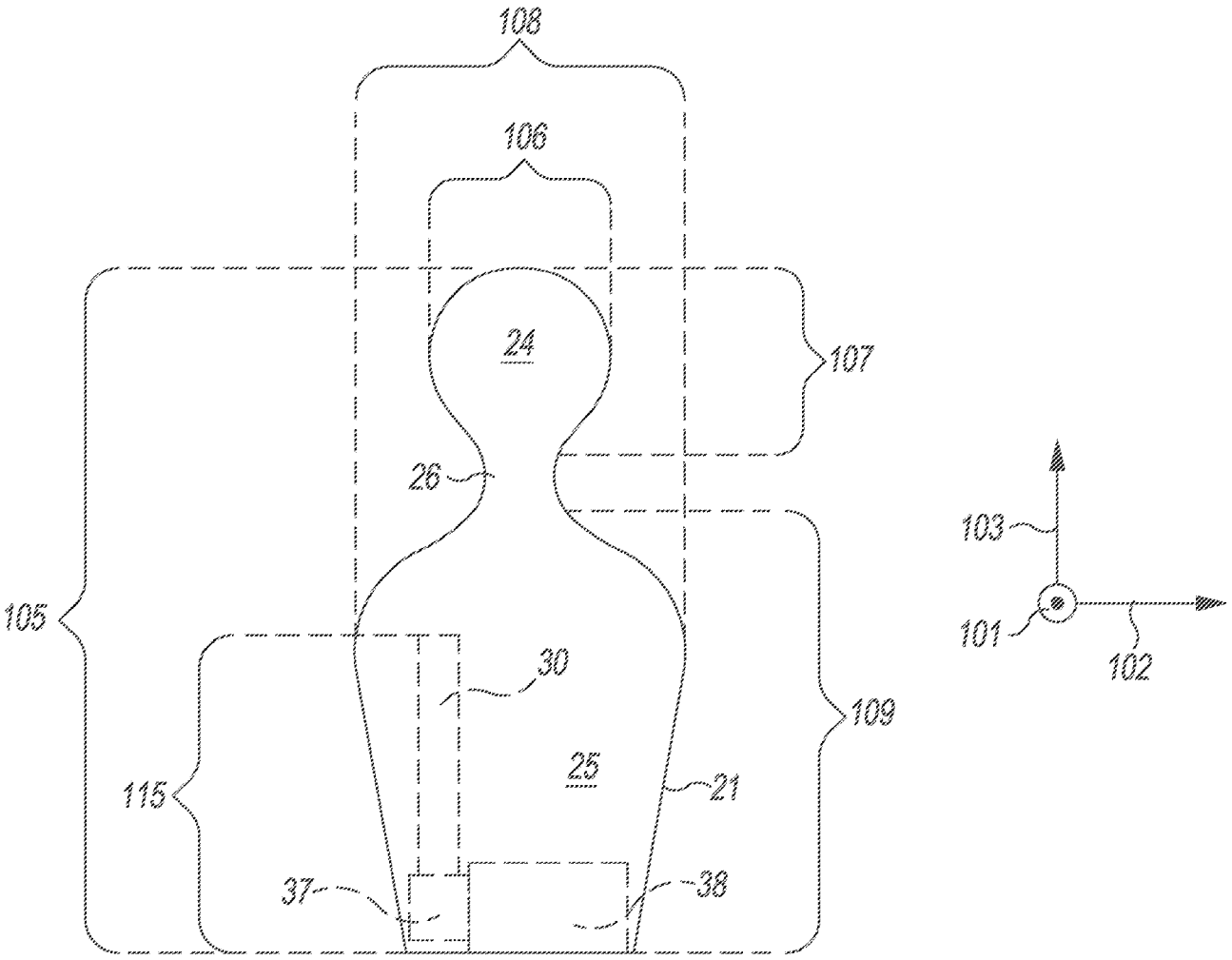

FIG. 35 is an enlarged diagrammatic frontal depiction of a preferred secondary object according to the present invention showing various comparative dimensions.

DETAILED DESCRIPTION OF THE PREFERRED EMBODIMENT

Referring now to the drawings with more specificity, the following specifications generally describe an amusement activity or game station or amusement activity for amusement park type facilities. The amusement activity or game station according to the presently disclosed subject matter basically provides an amusement activity enthusiast or participant user with an opportunity to operate complex machinery as variously exemplified to direct a first object into contact with at least one secondary object to exhibit or improve operable complex machinery object-to-object contact skills. In other words, the amusement activity or game station according to the presently disclosed subject matter enables a user to learn how to operate complex machinery in order to safely and skillfully contact environmental objects in the periphery of the complex machinery in a manner that is amusing.

Figure 1:
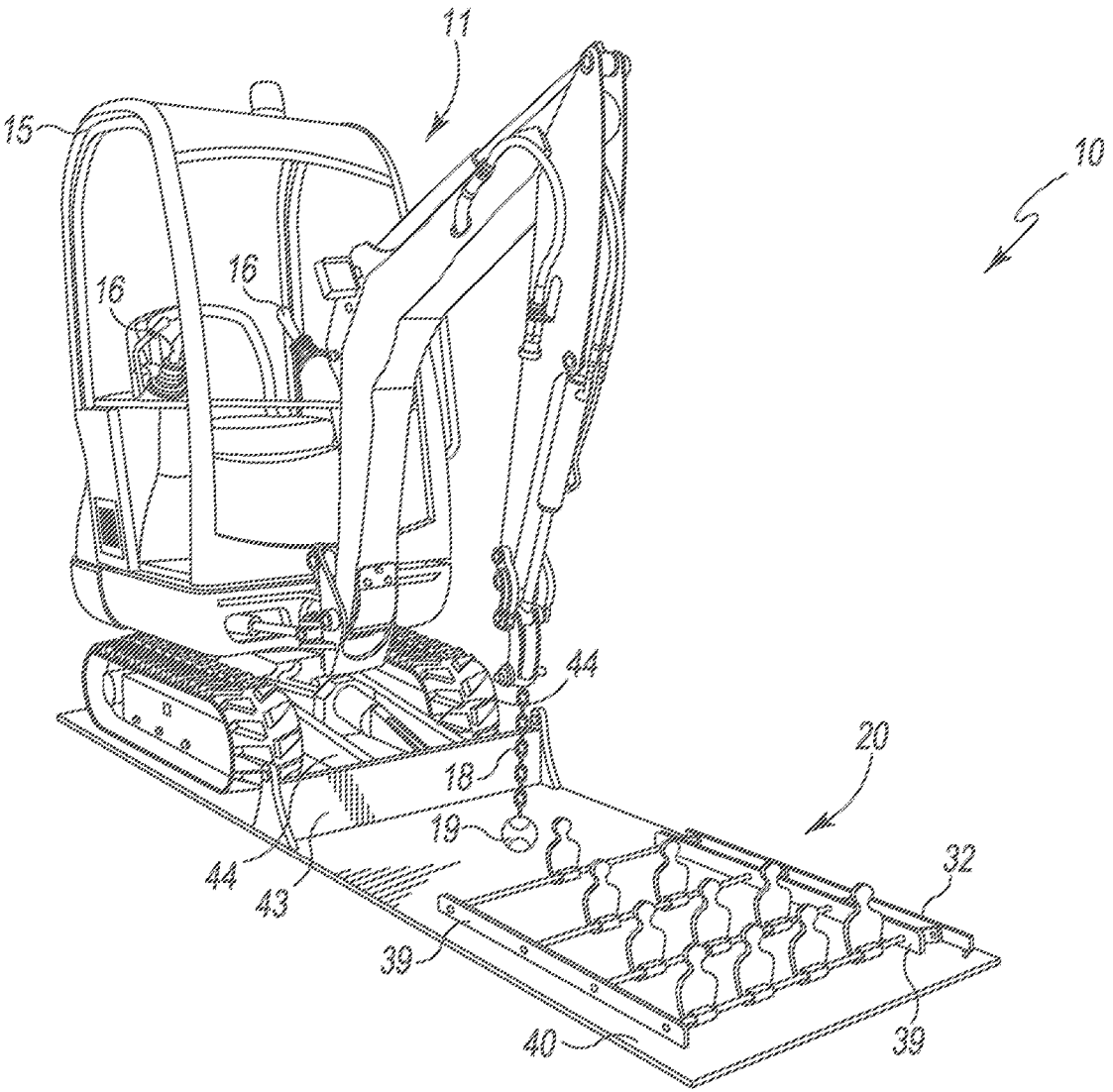
FIG. 1 is a perspective view of a preferred amusement game station according to the present invention showing a complex machine and a secondary object contact station supported by a station platform.
Figure 2:
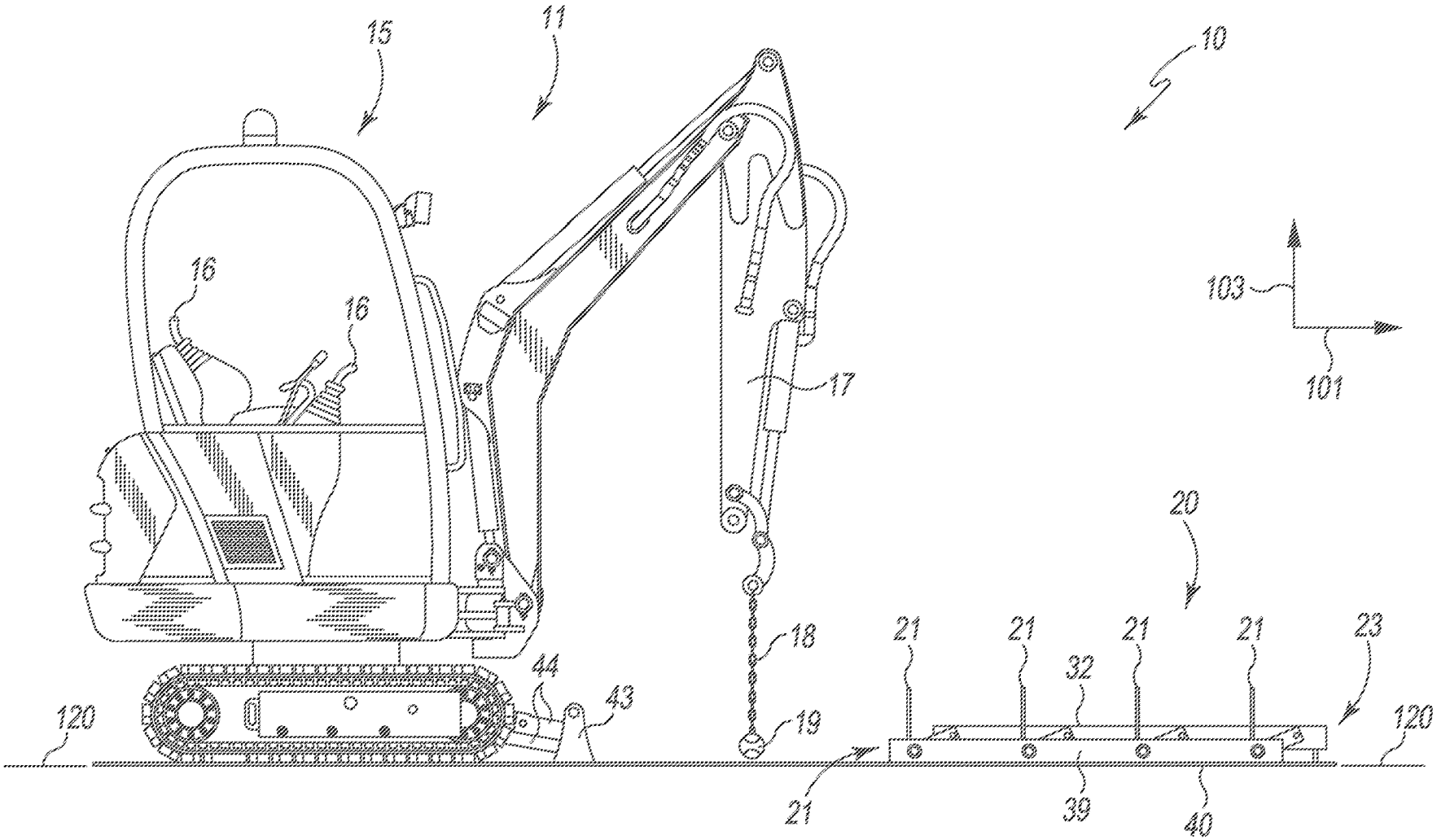
FIG. 2 is a lateral elevational view of the preferred amusement game station according to the present invention showing the complex machine and the secondary object contact station supported by the station platform.
Figure 3:
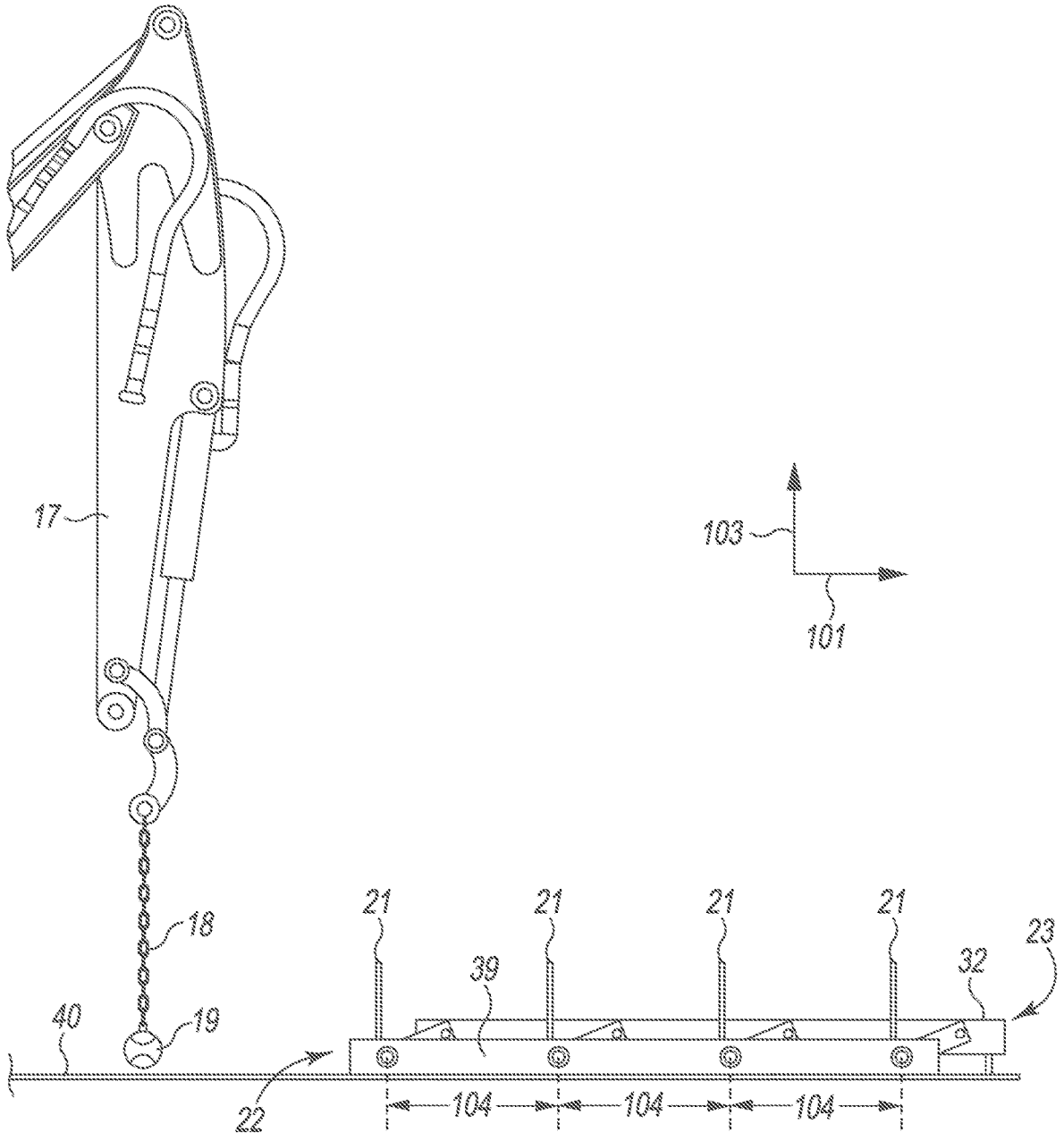
FIG. 3 is an enlarged fragmentary lateral elevational view as fragmented from FIG. 2 to show in greater clarity a moveable member with tethered first or primary striker object of the complex machine and the secondary object contact station supported by the station platform.
Figure 7:
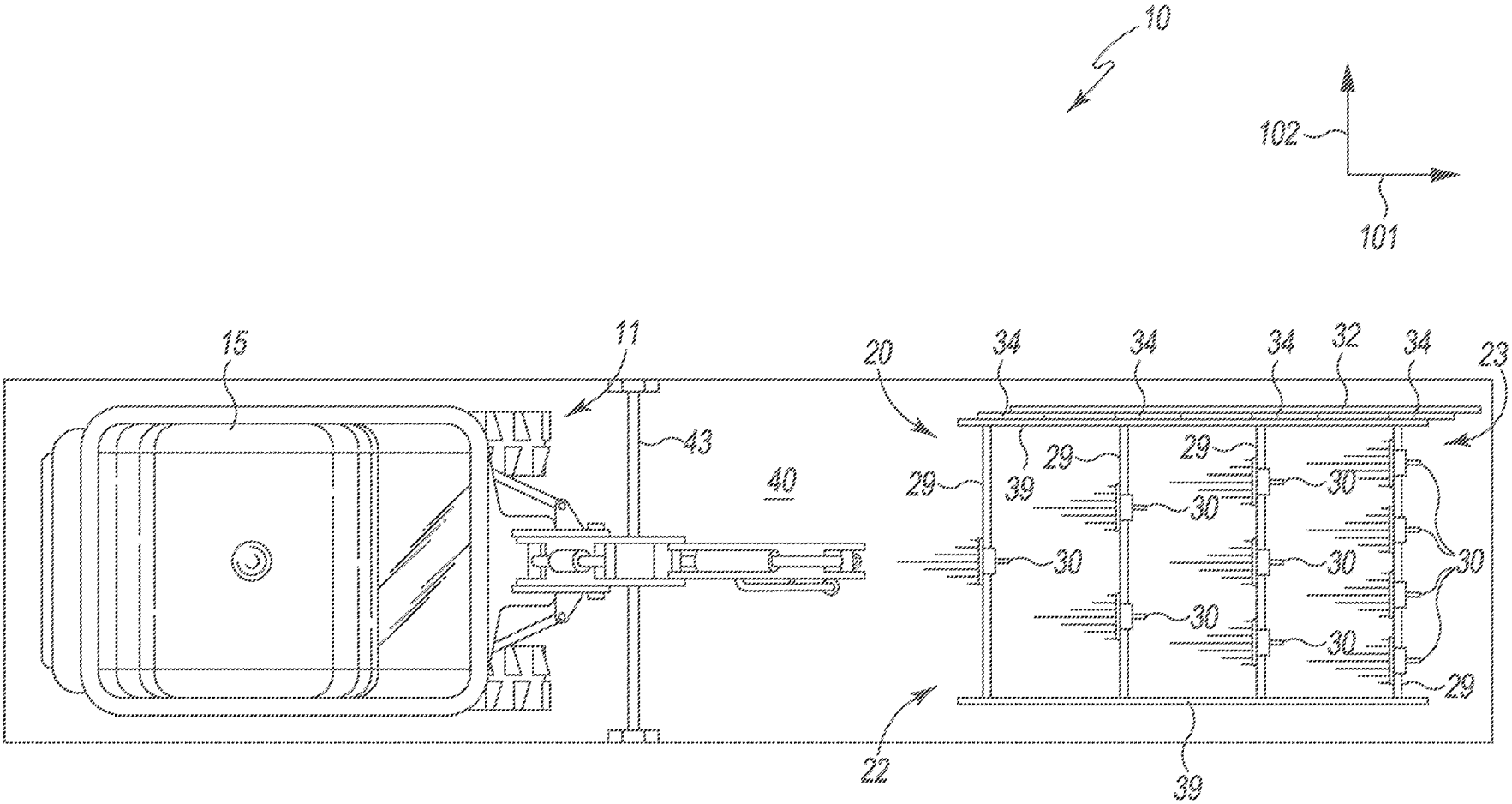
FIG. 7 is a top plan view of the preferred amusement game station according to the present invention showing the complex machine and the secondary object contact station supported by the station platform.
Figure 8:
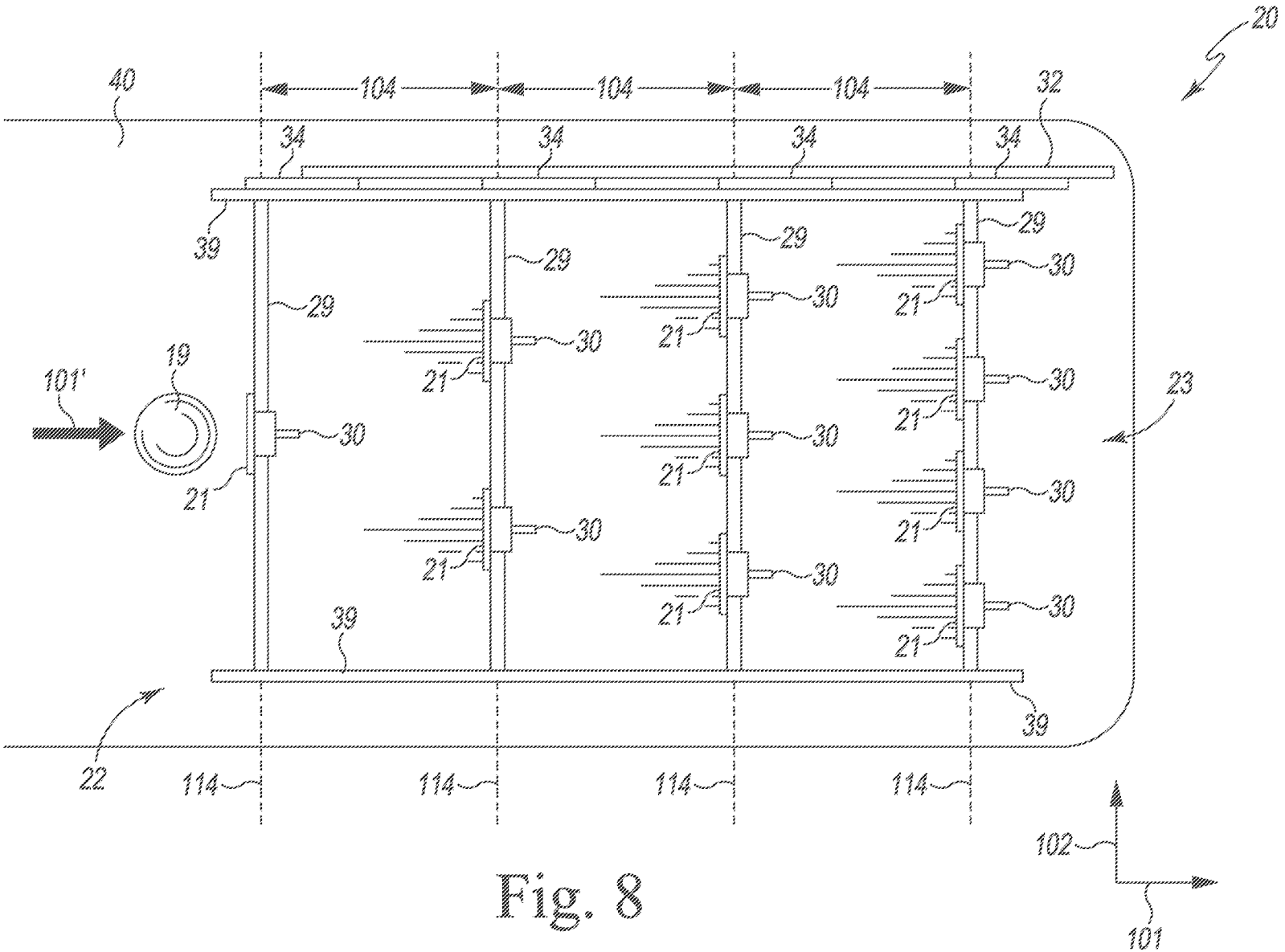
FIG. 8 is a first sequential, enlarged top plan view of the secondary object contact station supported by the station platform with the first or primary striker object being directed toward the proximal end of the secondary object contact station.

A preferred amusement activity or game station according to the presently disclosed subject matter is generally depicted and referenced at 10 in FIGS. 1, 2, and 7. Comparatively referencing FIGS. 1, 2, and 7, the reader will there firstly consider a mini-excavator type complex machine 11 of the amusement activity or game station. While the preferred amusement activity or game station 10 depicts a mini-excavator type complex machine 11 component in FIGS. 1, 2, and 7, it is contemplated the essential inventive concept of the amusement activity or game station 10 may be practiced by any number of complex machines as generally and comparatively further depicted in FIGS. 31-34. In other words, other types of heavy machinery or complex machines could conceivably be swapped in for a mini-excavator type complex machine 11 as exemplified by various cranes as generally and respectively depicted and referenced at 12 and 13 in FIGS. 31 and 32 or heavy lifting machine 14 as in FIG. 33.

The complex nature of the complex machine component of the amusement activity or game station 10 adds a certain amusing effect to the amusement activity or game station as user participants are seldom otherwise exposed to machines of that type. The amusement activity or game station 10 according to the presently disclosed subject matter affords participants with an opportunity to operate the machinery and in a manner that is safe and amusing. It is contemplated that the complex machine generically depicted and referenced at 11 according to the presently disclosed subject matter may essentially comprise a user or participant position station as at 15; a participant or user-to-machine interface as exemplified by one or more manual control(s) 16, and a moveable member or arm as at 17. It is to be understood that the complexity of such exemplary heavy equipment typically also comprises power systems, hydraulic systems, transmission systems, and other mechanical systems that help a user fully operate the machinery. The key features for enabling the subject matter of this invention comprise those features enumerated or listed above.

The moveable member or arm 17 is movable relative to the user position station 15 (e.g. a cab) by way of the user-to-machine interface 16 as manually operated by the participant or user. A first or primary striker object 19 may be preferably attached to the moveable member or arm 17 by way of one or more tether element(s) as at 18. The tether element 18 is preferably pivotally attached to the moveable member 17 and (removably or fixedly) attached to the first or primary (striker) object 19. As depicted, the first or primary object 19 is exemplified by a baseball type element, but it is contemplated that any number of objects may be attached to the tether element 18 for fulfilling the function.

Figure 4A:
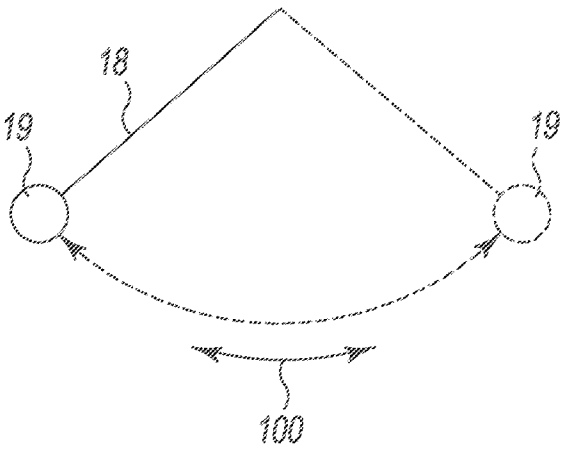
FIG. 4A is a diagrammatic depiction of a tether element and the first or primary striker object in pendular motion.
Figure 4:
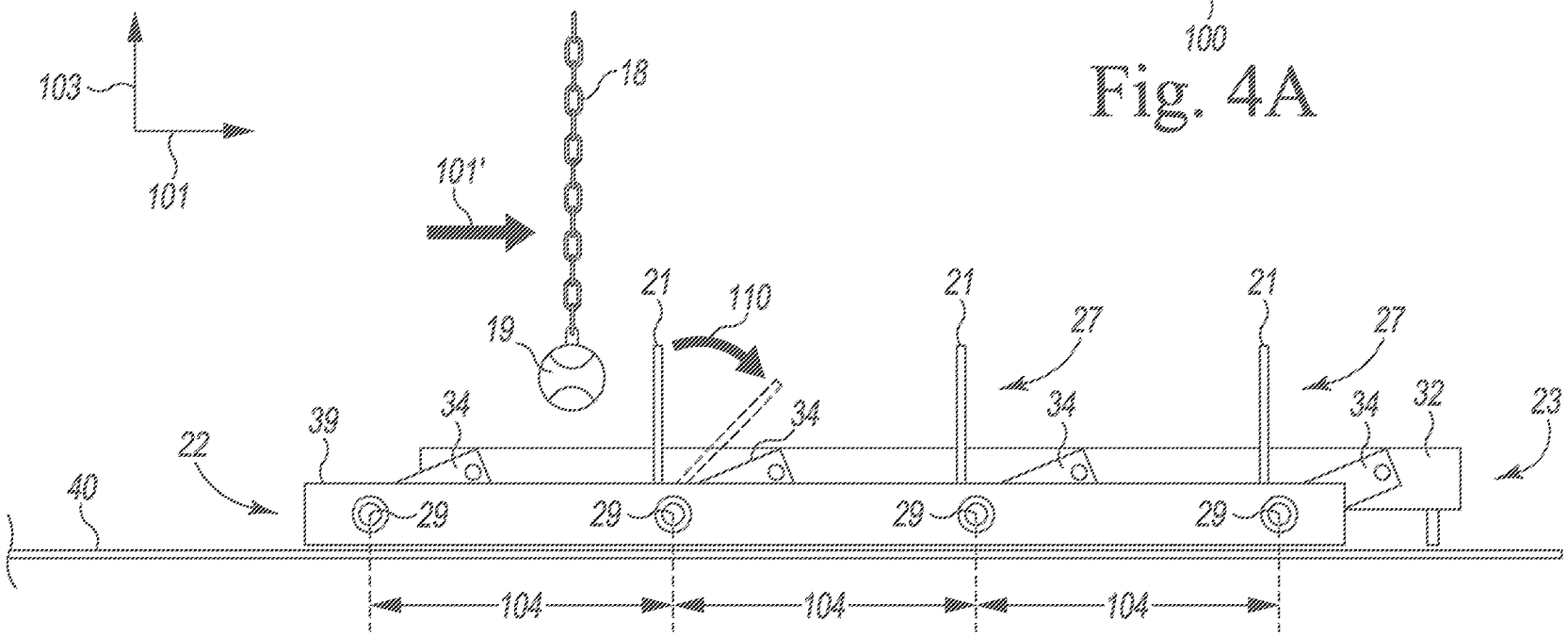
FIG. 4 is a first sequential, enlarged lateral elevational view of the secondary object contact station supported by a fragmentary portion of the station platform with a tether element and a first or primary striker object depicted in directed motion in superior adjacency to a proximal end of the secondary object contact station.
Figure 5:
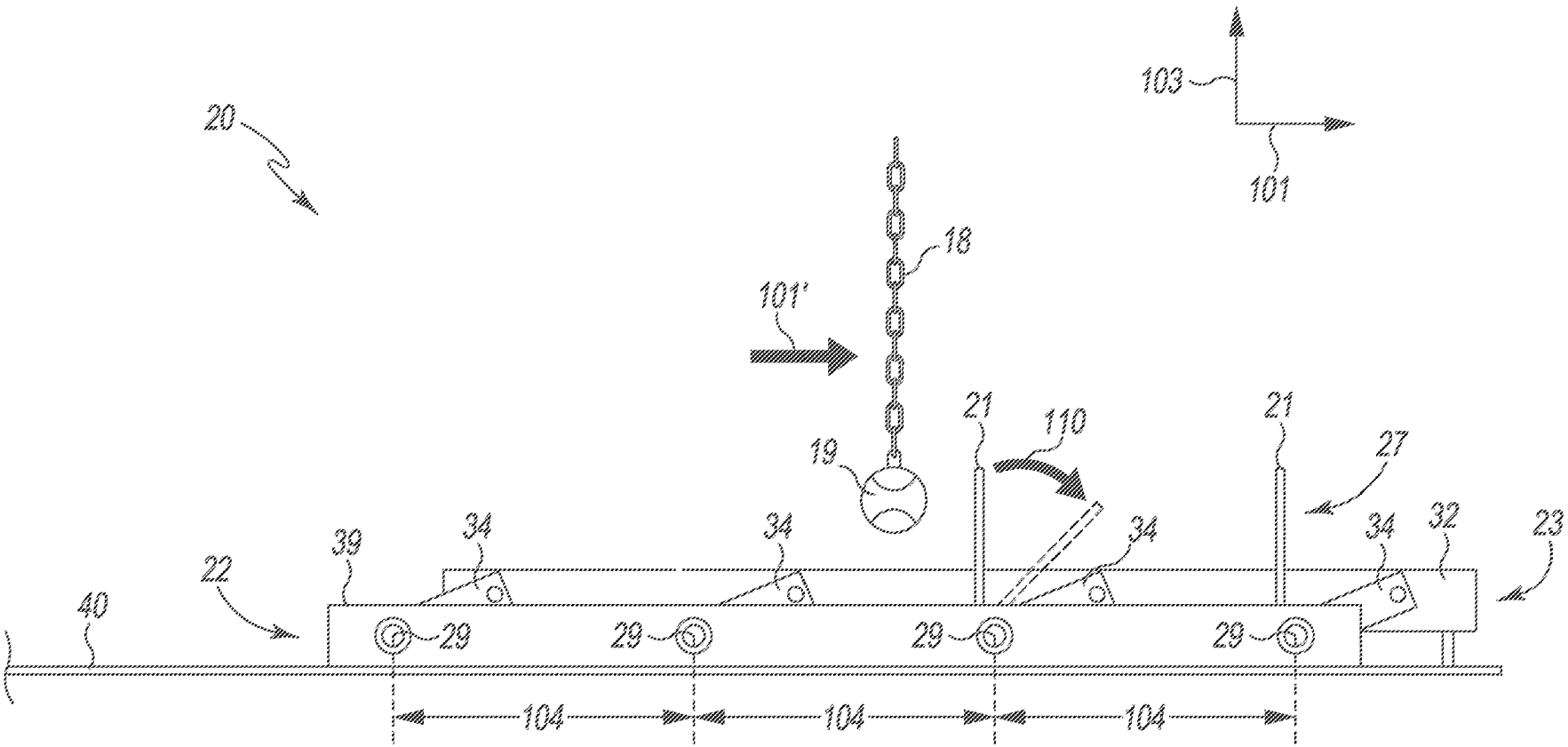
FIG. 5 is a second sequential, enlarged lateral elevational view of the secondary object contact station supported by a fragmentary portion of the station platform with the tether element and the first or primary striker object depicted in directed motion in superior adjacency to an intermediate portion of the secondary object contact station.
Figure 6:
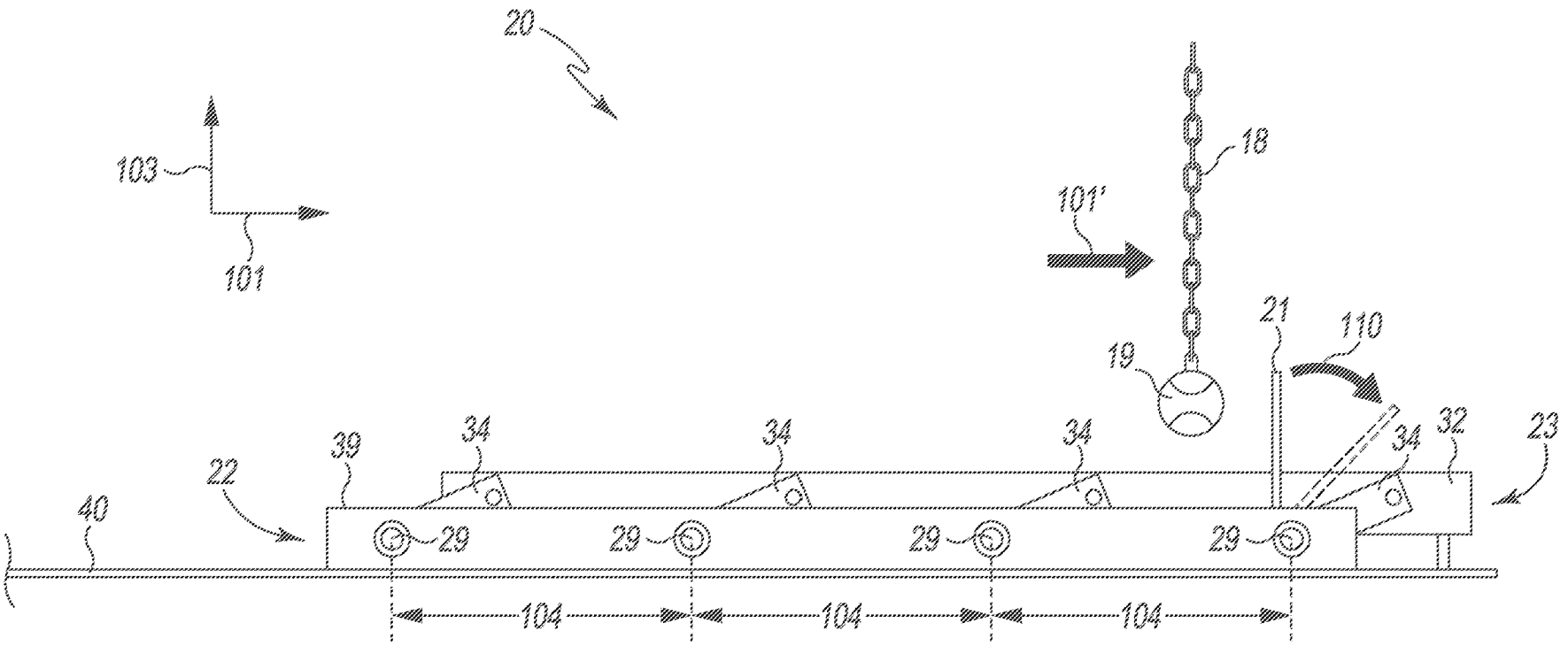
FIG. 6 is a third sequential, enlarged lateral elevational view of the secondary object contact station supported by a fragmentary portion of the station platform with the tether element and the first or primary striker object depicted in directed motion in superior adjacency to a distal end of the secondary object contact station.

When the first or primary object 19 is tethered to the moveable member 17, the primary object 19 may move with pendular motion as at 100 relative to the moveable member 17 as generally depicted in FIG. 4A. The first or primary object 19 may also be linearly directed as at 101'. The moveable (arm) member 17 (or other separate support structure adjacent the complex machine 11 or amusement activity station 10) may be further preferably outfitted with one or more cameras (not specifically illustrated) capable of capturing at least visual images from participant activity to further enhance the overall amusing experience of the user-participant(s).

The preferred amusement activity station 10 according to the present invention may further preferably comprise a secondary object contact station as at 20. The secondary object contact station 20 is positioned or situated opposite the complex machine 11 as perhaps best illustrated in FIGS. 2 and 7. The secondary object contact station 20 preferably comprises at least one, but preferably a series of secondary target objects as at 21. The moveable member or arm 17 is directable toward selected or targeted secondary target objects 21 in a first direction as at vector 101' in first dimension 101 for contacting or striking the selected or targeted secondary objects 21 via or by way of the first or primary striker object 19 as attached to the moveable member 17.

When the primary first object 19 is directed into and contact is made with a targeted secondary object 21, the targeted secondary object 21 preferably moves from an original position to a moved position. More particularly, the secondary target object, when contacted, preferably pivots as at 110 from a substantially vertical original upright position 27 extending in a third dimension 103 to a substantially horizontal moved or fallen position 28 extending in a first dimension 101 as generally and comparatively depicted in FIGS. 4-6 and 8-10. The secondary (target) objects 21 are each preferably pivotally attached to pivot members 29 via pivot type knuckle elements 38.

In a preferred embodiment, the series of secondary (target) objects 21 are spaced from one another in a secondary object spacing as at 104 in the first dimension 101. The secondary object spacing 104 is preferably uniform between successive secondary proximal-to-distal object positions, but alternatively may be non-uniform if desired. The successive secondary object positions are arranged from proximal to distal positions with proximal positions being those positions in closer proximity to the complex machine 11 and distal positions being those positions spaced relatively farther from the complex machine 11. It will thus be understood the secondary object contact station 20 comprises a proximal end as at 22 and a distal end as at 23.

Each secondary target object 21 preferably has a uniform secondary object height as at 105 in FIGS. 9, 10, and 35. The secondary object spacing 104 is preferably greater than the secondary object height 103 for allowing the series of secondary target objects 21 to be directed into the substantially horizontal fallen position within the secondary object spacing 104 as generally further depicted in FIGS. 9, 10, and 35. Comparatively referencing FIGS. 9, 10, and 35, the reader will note that distal-positioned secondary objects 21 are preferably and laterally staggered relative to proximal-positioned secondary objects 21.

The series of secondary target objects 21 may be uniformly shaped in the preferred embodiment, and in the preferred embodiment may resemble bowling pins when viewed from the first dimension or in direction 101' extending orthogonally thereto in second and third dimensions 102/103 for enhancing a user's ability to see and target the series of secondary target objects 21. When the series of secondary target objects 21 are shaped to resemble bowling pins, they provide a bowling pin arrangement resemblance for creating or enhancing the amusing effect of the amusement activity station 10. An alternative secondary contact station 20 could conceivably comprise secondary target objects 21 that resemble skyscrapers, and the first object 19 could conceivably resemble a wrecking ball thereby providing a cityscape arrangement resemblance. Any number of themed striker-target scenarios are contemplated as falling within the ambit of these specifications.

Referencing FIG. 35, the reader will there consider that series of secondary target objects 21 may each preferably comprise an upper (target) portion as at 24, a lower (target) portion as at 25, and a neck portion 26 extending intermediate the upper target portion 24 and the lower target portion 25. The upper target portion 24 preferably comprises a maximum upper target portion width as at 106 and a maximum upper target portion height as at 107. Similarly, the lower target portion 25 preferably comprises a maximum lower target portion width 108 and a maximum lower target portion height 109. The maximum lower target portion width 108 is greater than the maximum upper target portion width 106 in a preferred embodiment, and the maximum lower target portion height 109 is greater than the maximum upper target portion height 108 in a preferred embodiment. The upper target portion 24 and the lower target portion provide, so dimensioned, provide alternative target structures for directed movement of the first or primary striker object 19 into each secondary target object 21.

As earlier prefaced, uniform spacing between successive series of secondary target objects may be preferred, but alternative non-uniform spacing between, as well as non-uniform shapes and dimensions of secondary target objects are contemplated as falling within the ambit of these specifications although not specifically illustrated. Non-uniform spacing or staggered spacing might alternatively be incorporated, for example, to increase the degree of difficulty, to require some or all object(s) to be hit individually, or to allow space for the fall of non-uniform sized object(s).

The non-uniform secondary target objects may also alternatively be, in addition to the exemplary cityscape type formations, non-uniform is size or uniform in size but not appearance, such as 2-dimensional head-and-torso shapes (e.g. villainous personages), which could all be the same size but have a different appearance in terms of color, celebrity face, team logo, "point value" or other series or some other visual differentiation despite not having a size differentiation. Targeting positive point value secondary target objects (e.g. villainous personages), may for example, add point value to a gaming aspect of the present invention while inadvertent contact with negative point value secondary target objects (e.g. helpless townspeople) may subtract point value from the gaming aspect.

The amusement activity station 10 according to the present invention may further preferably comprise certain reset means or a reset mechanism for resetting the series of secondary target objects 21 from the substantially horizontal fallen position 28 to the substantially vertical upright position 27. The reset mechanism is cooperable with a series of pivot members as at 29 and a series of lift members as at 30. The preferred or exemplary reset mechanism according to the present invention comprises or is characterized by a linear actuator mechanism as at 31 (in separate communication 111 with an amusement activity game station operator, for example) and an actuator extension or reset bar/member as at 32. The linear actuator 31 is preferably (pivotally) coupled to the actuator extension or reset member 32 and is operable to essentially linearly actuate the actuator extension or reset member 32 in back and forth or to and from movements.

More particularly, the linear actuator 31 is preferably pivotally coupled to the reset member 32 at a first actuator end 33 with a first pivot axis 112 extending through the couple or attachment site. The reset member 32 is also attached to each of the pivot members 29 by way of or via linkage members 34. The linkage members 34 are each preferably dimensioned for cooperating with a maximum linear actuation state (as depicted in FIGS. 13 and 14) and a minimum linear actuation state (as depicted in FIG. 16) of the linear actuator 31 for pivoting the lift members 30 through a preferred reset angle of substantially 90 degrees. The linear actuator 31 further comprises a second actuator end as at 35, which second actuator end 35 is preferably pivotally coupled to an anchor structure or anchor bracket as at 36 with a second pivot axis 113 extending through the attachment site. The first and second actuator ends 33 and 35 are preferably pivotally coupled to opposed structure for enabling the linear actuator 31 to pivot as necessary during reset movements of the reset mechanism to prevent structural stress on the linear actuator 31.

As prefaced above, the reader will recall the secondary target objects 21 are preferably arranged in a series of rows as spaced according to the secondary object spacing 104. Each row is essentially defined by or comprises a pivot member 29, and each secondary target object 21 is cooperably associated with a lift member 30. The lift members 30 are fixedly attached to the pivot members 29 at fixing type knuckle elements 37 and pivot with the pivot members 29 about pivot axes 114 during secondary target object 21 reset movements. The reader will note that each lift member 30 preferably comprises an effective lift member length as at 115. The lift member length or effective lift member height 115 is preferably lesser than the secondary object height 105 such that the series of secondary target objects 21 conceal from view the lift members 30 during secondary target object 21 reset movements.

The secondary object contact station 20 may further preferably comprise laterally opposed anchor members as at 39. The laterally opposed anchor members 39 are affixed to a station platform 40 and pivotally receive each pivot member 29. The station platform 40 and laterally opposed anchor members 39 together function to help fix the pivot axes 114 extending through each pivot member 29. The station platform 40 may further preferably comprise a contact station portion as at 41 and a machinery support portion as at 42. The contact station portion 41 essentially functions to support the secondary object contact station 20 and the machinery support portion 42 essentially functions to support the complex machine 11.

The station platform 40 may further preferably comprise a fixedly attached portion divider as at 43. The fixedly attached portion divider 43 extends upwardly intermediate the contact station portion 41 and the machinery support portion 42 for preventing the complex machine 11 from being inadvertently directed into the secondary object contact station 20. The complex machine 11 may be preferably coupled or anchored to the fixedly attached portion divider 43 by anchor members 44 thereby fixing the complex machine 11 to the station platform 40. The station platform 40 may be further preferably fixedly attached to an underlying anchor support surface as at 120 thereby fixing the amusement activity station 10 to the underlying anchor support surface 120. In this last regard, it is contemplated that the station platform 40 may be bolted as at 45 to the underlying anchor support surface 120.

While the above descriptions contain much specificity, this specificity should not be construed as limitations on the scope of the invention, but rather as an exemplification of the invention. In certain alternative embodiments, the basic invention may be said to essentially teach or disclose an amusement activity or game station for enabling a user to operate complex machinery to direct a first or primary striker object into contact with at least one secondary object and thereby improve or maintain operable complex machinery object-to-object contact skills. The amusement activity or game station according to the presently disclosed subject matter may be said to essentially comprise a complex machine and a secondary object contact station.

The complex machine according to the present invention preferably comprises a user position station, a user-to-machine interface, and a moveable member. The moveable member is movable relative to the user position station by way of the user-to-machine interface as manually operated by the user. The secondary object contact station is positioned opposite the complex machine and preferably comprises at least one, but preferably a series of secondary objects. The moveable member is directable toward the secondary object(s) in at least a first direction for contacting the secondary object(s) by way of the primary striker object as attached to the moveable member.

The amusement activity or game station according to the present invention may further preferably comprise a number of features, including a reset mechanism for resetting the secondary object(s). In this regard, it is contemplated that in the preferred embodiment the secondary objects may pivot from a substantially vertical or upright position to a substantially horizontal or fallen position when the first or primary striker object is directed into and contact is made with the secondary object(s). The reset mechanism is operable to reset the secondary objects from the substantially horizontal or fallen position to the substantially vertical or upright position.

The first or primary striker object is preferably attached to the moveable member via a tether element, which tether element is pivotally attached to the moveable member and fixedly attached to the first or primary striker object. The opposing pivotal and fixed attachment points enable the first or primary striker object to move under pendular motion relative to the moveable member. When the secondary object contact station is outfitted with a series of secondary objects, the secondary object are preferably spaced from one another in at least one of first and second dimensions within certain secondary object spacing. The secondary object spacing enables the user participant to manipulate the moveable member in either of the first and second dimensions so as to develop or maintain skills required to accurately move the moveable member to and fro and/or from side to side.

The secondary object spacing is preferably, but not necessarily uniform between successive secondary objects positions. In a preferred embodiment, the successive secondary object positions are arranged from proximal to distal positions in the first dimension. Each secondary object may preferably further comprise a uniform secondary object height. The secondary object spacing is preferably greater than the secondary object height for allowing the series of secondary objects to be directed into the substantially horizontal or fallen position within the secondary object spacing. It will be recalled that while uniform spacing between successive series of secondary target objects may be preferred, alternative non-uniform spacing between, as well as non-uniform shapes and dimensions of secondary target objects are contemplated as falling within the ambit of these specifications although not specifically illustrated.

Distally positioned or distal-positioned secondary objects are preferably laterally staggered relative to proximally positioned or proximal-positioned secondary objects and the lateral spacing between and shape of secondary objects may preferably be uniform. The series of secondary objects may preferably comprise an upper portion, a lower portion, and a neck portion. The upper portion may preferably comprise a maximum upper portion width and a maximum upper portion length or height. Similarly, the lower portion may preferably comprise a maximum lower portion width and a maximum lower portion length or height. The maximum lower portion width is preferably greater than the maximum upper portion width, and the maximum lower portion height is preferably greater than the maximum upper portion height.

The upper portion and lower portion dimensions thereby provide alternative target structure for directed movement of the first or primary striker object into each secondary object. In an exemplary embodiment, the series of secondary objects may preferably resemble bowling pins in at least the first dimension for providing a bowling pin arrangement resemblance. The bowling pin arrangement resemblance creates a particularly amusing effect of the amusement activity station. Other similar types of themed arrangements may also be substituted in for the bowling pin arrangement resemblance as exemplified hereinabove by a cityscape resemblance opposite a wrecking ball type primary striker object.

The series of secondary objects are preferably arranged in a series of rows, which series of rows are preferably spaced according to the secondary object spacing. Each row may preferably comprise or essentially be defined by a pivot member. The secondary objects may preferably pivot about the pivot members when being directed from the substantially vertical or upright position to the substantially horizontal or fallen position. Each secondary object is preferably associated with a lift member, which lift members are fixedly attached to the pivot members such that the lift members may pivot in unison with the pivot members for lifting the secondary objects from the substantially horizontal or fallen position to the substantially vertical or upright position. Each lift member preferably comprises a lift member length or height. The lift member length or height is preferably lesser than the secondary object height such that the series of secondary objects thereby concealing from view the lift members during object reset movements.

The reset mechanism according to the present invention is cooperable with the pivot members and lift members. The reset mechanism preferably comprises or is characterized by a linear actuator mechanism and a reset member or bar. The linear actuator is coupled to the reset member and is operable to linearly actuate the reset member in at least to and fro movements. The linear actuator may be pivotally coupled to the reset member at a first actuator end, and the reset member may be coupled to the pivot members via linkage members. The linkage members are each dimensioned for cooperating with a maximum linear actuation state and a minimum linear actuation state of the linear actuator for pivoting the lift members through a preferred reset angle of rotation on the order of 90 rotational degrees. The linear actuator further comprises a secondary actuator end pivotally coupled to an anchor structure. The first and secondary actuator ends are pivotally coupled to opposed structure for enabling the linear actuator to pivot during reset movements of the resent mechanism and reduce structural strain on the mechanism.

The secondary object contact station may further preferably comprise laterally opposed members. The laterally opposed members are preferably affixed to a station platform and pivotally attached to each pivot member. The station platform and laterally opposed members function to fix the pivot axes extending through each pivot member. The station platform may further preferably comprise a contact station portion and a machinery support portion. The contact station portion supports the secondary object contact station and the machinery support portion supports the complex machinery.

The station platform may further preferably comprise a fixedly attached portion divider. The fixedly attached portion divider extends upwardly intermediate the contact station portion and the machinery support portion for preventing the complex machinery from being inadvertently directed into the secondary object contact station. The complex machine is preferably coupled or anchored to the fixedly attached portion divider thereby fixing the complex machine in position relative to the station platform. The station platform is further preferably fixedly attached or anchored to an underlying anchor support surface for fixing or anchoring the entire amusement activity station to the underlying anchor support surface.

The foregoing embodiments illustrate the principles, preferred or example embodiments, and modes of assembly and operation, of the invention. It is noted, however, the invention is not, and shall not be construed as being exclusive or limited to the specific or particular embodiments herein. Moreover, certain specific or particular embodiments herein have been expressly designated optional, and thus the invention includes the invention with, or without, any or all embodiments herein expressly designated as optional.

Accordingly, all embodiments herein should be regarded as illustrative rather than exclusive or limiting, and variations to embodiments herein may be made without departing from the invention scope. In other words, although the amusement activity or game station according to the presently disclosed subject matter have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

What is claimed is:

1. An amusement activity station comprising:

a complex machine comprising a user position station, a user-to-machine interface, and a moveable member, the user-to-machine interface operable to move the moveable member relative to the user position station;

a secondary object contact station in spaced relation to the complex machine and comprising:

at least one pivot member; and at least one secondary target object, wherein the at least one secondary target object is rotatable with respect to the at least one pivot member and configured to rotate from an upright position to a fallen position; and a reset mechanism coupled to the at least one pivot member for resetting the at least one secondary target object from the fallen position to the upright position, the reset mechanism comprising a linear actuator and a reset member, wherein the linear actuator is configured to linearly translate the reset member.

2. The amusement activity station of claim 1, wherein the complex machine comprises a primary striker object and a tether element, the primary striker object being attached to the moveable member via the tether element, wherein the tether element is pivotally attached to the moveable member thereby enabling the primary striker object to move under pendular motion relative to the moveable member, the moveable member being directable toward the at least one secondary target object in a first direction for contacting the at least one secondary target object via the primary striker object.

3. The amusement activity station of claim 1, wherein the secondary object contact station comprises a series of secondary target objects, the series of secondary target objects being spaced apart from one another in a secondary object spacing, the secondary object spacing being in the first direction.

4. The amusement activity station of claim 3, wherein the secondary object spacing is uniform between successive secondary target object positions, the successive secondary target object positions being proximally to distally arranged, the secondary target objects having a uniform secondary object height, the secondary object spacing being greater than the uniform secondary object height for allowing the series of secondary target objects to be directed into the fallen position within the secondary object spacing.

5. The amusement activity station of claim 3, wherein distally positioned secondary target objects are laterally staggered relative to proximally positioned secondary target objects.

6. The amusement activity station of claim 3, wherein the series of secondary target objects are uniformly shaped, each secondary target object comprising an upper target portion, a lower target portion, and a neck portion extending intermediate the upper target portion and the lower target portion, the upper target portion comprising a maximum upper target portion width and a maximum upper target portion height, the lower target portion comprising a maximum lower target portion width and a maximum lower target portion height, the maximum lower target portion width being greater than the maximum upper target portion width, the maximum lower target portion height being greater than the maximum upper target portion height.

7. The amusement activity station of claim 3, wherein the series of secondary target objects are arranged in a series of rows, the series of rows being spaced according to the secondary object spacing, each row comprising a pivot member, each secondary target object being associated with a lift member fixedly attached to the pivot member associated with one of the rows.

8. The amusement activity station of claim 7, wherein each lift member comprises a lift member length, the lift member length being lesser than a secondary object height associated with each secondary target object, the series of secondary target objects thereby concealing the lift members from view by the user during object reset movements.

9. An amusement activity station comprising:

a complex machine comprising a user position station, a user-to-machine interface, a moveable member, and a first object attached to the moveable member, the user-to-machine interface operable to move the movable member relative to the user position station;

a secondary object contact station in spaced relation to the complex machine and comprising at least one secondary object and at least one pivot member; and a reset mechanism for resetting the at least one secondary object from a moved position to an original position, the reset mechanism being cooperable with the at least one pivot member, wherein the reset mechanism comprises a linear actuator and an actuator extension, the linear actuator and the actuator extension together being linearly actuable to reset the at least one secondary object.

10. The amusement activity station of claim 9, wherein the secondary object contact station comprises a series of secondary objects, the series of secondary objects being spaced apart from one another in a secondary object spacing.

11. The amusement activity station of claim 10, wherein the secondary object spacing is uniform between secondary object positions, each secondary object having a uniform maximum secondary object dimension, the secondary object spacing being greater than the maximum secondary object dimension for allowing the series of secondary objects to be directed into moved positions within the secondary object spacing.

12. The amusement activity station of claim 11, wherein the series of secondary objects are arranged in a series of rows, each row comprising a pivot member and each secondary object being associated with a lift member, each lift member being fixedly attached to one of the pivot members.

13. The amusement activity station of claim 12, wherein each lift member comprises a lift member length, the lift member length being less than the maximum secondary object dimension, the series of secondary objects thereby concealing from view the lift members during object reset movements.

14. The amusement activity station of claim 12, wherein the linear actuator is pivotally coupled to the actuator extension at a first actuator end, the actuator extension being coupled to the pivot members via linkage members, the linkage members each being dimensioned for cooperating with a maximum linear actuation state and a minimum linear actuation state of the linear actuator for pivoting the lift members through a reset angle, the linear actuator comprising a secondary actuator end, the secondary actuator end being pivotally coupled to an anchor structure, the first and secondary actuator ends being pivotally coupled to opposed structure enabling the linear actuator to pivot during reset movements of the reset mechanism.

15. The amusement activity station of claim 14, wherein the secondary object contact station comprises laterally opposed anchor members, the laterally opposed anchor members being affixed to a station platform and pivotally attached to each pivot member, the station platform and laterally opposed members for fixing pivot axes extending through each pivot member.

16. The amusement activity station of claim 10, wherein the series of secondary objects each comprise an upper portion, a lower portion, and a neck portion extending intermediate the upper portion and the lower portion, the upper portion comprising a maximum upper portion width and a maximum upper portion height, the lower portion comprising a maximum lower portion width and a maximum lower portion height, the maximum lower portion width being greater than the maximum upper portion width, the maximum lower portion height being greater than the maximum upper portion height.

17. The amusement activity station of claim 9, wherein the moveable member is directable toward the at least one secondary object in a first direction for contacting the at least one secondary object via the first object, wherein the first object is configured to move the at least one secondary object from the original position to the moved position upon contact therewith.

* * * * *